US006418639B1

(12) United States Patent
Virta et al.

(10) Patent No.: US 6,418,639 B1
(45) Date of Patent: Jul. 16, 2002

(54) METHOD AND DEVICE IN THE DRYER SECTION OF A PAPER/BOARD MACHINE

(75) Inventors: Raimo Virta, Turku; Pekka Saarikivi, Raisio; Juha Kaihovirta, Jyväskylä; Kari Juppi, Palokka; Nenad Milosavljevic, Turku, all of (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/509,965

(22) PCT Filed: Oct. 2, 1998

(86) PCT No.: PCT/FI98/00777

§ 371 (c)(1),
(2), (4) Date: Jul. 12, 2000

(87) PCT Pub. No.: WO99/18287

PCT Pub. Date: Apr. 15, 1999

(30) Foreign Application Priority Data

Oct. 3, 1997 (FI) ..... 973885

(51) Int. Cl.[7] ..... F26B 3/00

(52) U.S. Cl. ..... 34/455; 34/444; 34/448; 34/452; 34/114; 34/117; 34/119; 34/120; 34/124

(58) Field of Search ..... 34/444, 448, 452, 34/455, 114, 117, 119, 120, 122, 124

(56) References Cited

U.S. PATENT DOCUMENTS

| | | | | |
|---|---|---|---|---|
| 4,064,637 A | | 12/1977 | Lindgren | 34/122 |
| 4,905,380 A | | 3/1990 | Eskelinen et al. | 34/23 |
| 5,022,163 A | | 6/1991 | Ilvespää et al. | 34/23 |
| 5,214,861 A | | 6/1993 | Vuorinen | 34/114 |
| 5,397,438 A | | 3/1995 | Nyberg et al. | 162/207 |
| 5,416,980 A | * | 5/1995 | Ilvespaa | 34/117 |
| 5,600,898 A | | 2/1997 | Deshpande et al. | 34/116 |
| 6,105,277 A | * | 8/2000 | Lindberg et al. | 34/456 |
| 6,128,833 A | * | 10/2000 | Juppi et al. | 34/464 |

FOREIGN PATENT DOCUMENTS

| | | |
|---|---|---|
| EP | 0427218 | 5/1991 |
| EP | 0620313 | 10/1994 |
| EP | 0761872 | 3/1997 |
| FI | 83680 | 4/1991 |
| FI | 86447 | 5/1992 |
| FI | 961612 | 3/1999 |
| JP | 5222691 | 8/1993 |

* cited by examiner

*Primary Examiner*—William C. Doerrler
*Assistant Examiner*—Mark Shulman
(74) *Attorney, Agent, or Firm*—Steinberg & Raskin, P.C.

(57) ABSTRACT

The invention concerns a method and a device in the dryer section of a paper/board machine. In the dryer section a normal single-wire draw is applied at least partly, in which method the web (W) is passed through the dryer group on support of a drying wire (H). The drying wire (H) presses the web (W) on the drying cylinders ($K_n$, $K_{n+1}$ . . . ) against the heated cylinder faces, and on the reversing cylinders or rolls ($S_n$, $S_{n+1}$ . . . ) between the drying cylinders (10) the web (W) remains at the side of the outside curve. There is one integrated device, through which a support suction and/or blowing is produced in order to improve the runability of the web (W) and to keep the web (W) in contact with the face of the wire, and through which same device, additionally, impingement blowing is produced in order to dry the web (W) and/or to control its tendency of curling.

21 Claims, 18 Drawing Sheets

METHOD AND DEVICE IN THE DRYER SECTION OF A PAPER/BOARD MACHINE

FIELD OF THE INVENTION

The present invention relates to a method for a dryer section of a paper or board machine having a single-wire draw.

The present invention relates to a device in a dryer section of a paper or board machine having a single wire draw.

BACKGROUND OF THE INVENTION

As is known from the prior art, in multi-cylinder dryers in paper machines, twinwire draw and/or single-wire draw is/are employed. In twin-wire draw, the groups of drying cylinders include two wires, which press the web, one from above and the other one from below, against heated cylinder faces. Between the rows of drying cylinders, which are usually horizontal rows, the web has free and unsupported draws, which are susceptible of fluttering, which may cause web breaks, in particular as the web is still relatively moist and, therefore, of low strength. This is why, in recent years, ever increasing use has been made of said single-wire draw, in which each group of drying cylinders has one drying wire only, on whose support the web runs through the whole group so that the drying wire presses the web on the drying cylinders against the heated cylinder faces, and on the reversing cylinders or rolls placed between the drying cylinders the web remains at the side of the outside curve. Thus, in single-wire draw, the drying cylinders are placed outside the wire loop, and the reversing cylinders or rolls inside the wire loop.

It is known from experience that, if paper is dried one-sidedly, the result is a tendency of curling of the sheet. When paper is dried by means of normal groups with single-wire draw from the side of its lower face, and if such asymmetric drying is extended over the entire length of the dryer section, the drying takes place so that first the side of the bottom face of the paper web is dried, and when the drying makes progress, the drying effect is also spread to the side of the top face of the paper web. Thus, the dried paper is, as a rule, curled so that it becomes concave when viewed from above. From the point of view of runnability of the paper machine, however, a dryer section with full support over its entire length and based on normal groups with single-wire draw, without inverted groups, would be a particularly justified solution.

With respect to the prior art related to the present invention, reference is also made to the U.S. Pat. No. 5,600,898, in which an arrangement related to the control of curling in the dryer section of a paper machine is described. It is a drawback in said arrangement that it does not permit the use of a runnability component operating with the principle of blowing, which is a definite requirement when running takes place with open wires at high speeds.

OBJECTS AND SUMMARY OF THE INVENTION

One of the objects of the present invention is to provide a solution which permits a dryer section based on normal groups with single-wire draw.

In the solution of method and solution of equipment in accordance with the present invention, in its commonest embodiment, the web support function and the web impingement drying function have been accomplished by means of the same solution of equipment, which comprises one continuous hood, i.e. box construction, for the device. In accordance with the invention, said equipment extends into the pocket space between the drying cylinders and the suction roll that operates as a reversing roll so that air is removed out of said pocket space and/or an ejection blowing is produced in said pocket space along the wire, in which case the web is affixed to the wire face by means of a vacuum. Since, favourably, wires of high permeability are employed, application of the vacuum to the web in this way is possible. In accordance with the invention, by means of the same solution of equipment extending into the pocket space, impingement drying is also carried out. Preferably air, favourably heated air, or steam is employed. Within the scope of the present invention, an embodiment is possible in which, through the impingement drying unit, a part of the impingement drying air is passed through the interior of the box construction to the end of the box construction and/or further as an ejection jet and/or as a closing jet and/or as an exhaust blow jet at the inlet and outlet side of the suction roll in the vicinity of the wire/web. Thus, in a preferred embodiment of the invention, the impingement drying hood extends onto the drying cylinder and further into the pocket space.

In the embodiments defined in the sub-claims of the invention, it is suggested that the device be employed in certain areas of the dryer section, for example in the areas of the dryer section in which the dry solids content of the web is higher than 60%. In such a case, impingement drying is employed in particular for prevention and control of the curl of the web.

The invention is characterized in what is stated in the patent claims.

The present invention is applied in a dryer section in which a normal single-wire draw is applied at least partially. The dryer section may also be such that it is provided with impingement drying units.

Out of the impingement drying units, hot air/steam is blown through the wire onto the paper. By means of such an impingement drying unit, a considerable increase in the evaporating capacity is achieved. In such a case, the evaporation takes place to an increasing extent from the wire side on the cylinder. Owing to the increased evaporating capacity, the dryer section can be made of shorter length, and in this way economies can be obtained in the cost of construction of the hall. Owing to the increased evaporating capacity, the concept of the present invention can also be applied to modernizations, in which the available space is often quite limited.

From the patent application JP 222 691/1993, a dryer section is known in which there is an impingement drying hood above all of the upper cylinders. Thus, it has been known from the prior art to enhance the evaporation taking place on a cylinder by ventilating the rear side of the wire or by blowing hot air partly through the drying wire.

By means of studies carried out on test devices, it has been established that the evaporating capacity that can be achieved depends highly extensively on the permeability of the wire. In order that an increase in the evaporating capacity could have economic significance, the permeability of the wire must be preferably in the range of 2000 . . . 20,000 $m^3/h/m^2$ (cubic metres per hour per square metre), preferably 4000 . . . 10,000 $m^3/h/m^2$. The permeability, i.e. permeability to air, of a wire H is the flow rate as cubic metres of air per hour that passes through an area of a size of one square metre of a wire when the pressure difference across the wire is 100 Pa.

Formation of pressure in a closing nip is prevented so efficiently that no bag formation in the web takes place. One possible alternative solution is a runnability component, which prevents passing of air into a closing nip by means of suction and permits the use of an open wire, in which case evaporation from the top side of the web can be enhanced, for example, by means of solutions of the type of impingement drying hoods. It is possible to employ a suction box that fills the whole pocket at the suction roll, which suction box is provided with preventive blowings at the edges in order to prevent leakage of air into the pocket.

In the preferred case, the necessary portion of the dryer section or the whole dryer section consists of assemblies with the construction described above. It is a great advantage of this solution that there is no need for an inverted group, which is difficult in view of cleaning, and it is, nevertheless, possible to dry the web efficiently and even to regulate the drying capacity at the top side and bottom side of the web by means of the speed and temperature of the impingement drying air.

In the present invention, impingement drying hoods are preferably placed in connection with those cylinders only at which they provide a considerable effect either in the control of curl or in increasing the drying capacity.

When the impingement drying is carried out through the wire, the paper is protected between the wire and the cylinder, and the paper cannot form folds which might collide against the impingement drying device and damage it.

Increased evaporation on the cylinder normally causes a lowering of the average temperature of the web and thereby somewhat reduces the evaporation taking place in the area of a free draw, but, on the other hand, the delivery of heat by the cylinder is increased, which increases the overall evaporation.

In the dryer section in a paper machine, in an area of single-wire draw, it is known from the prior art to employ various blow boxes or runnability components in order to improve the runnability of the dryer section. One such runnability component is described in the applicant's U.S. Pat. No. 4,905,380 (FI Patent 80,491), in whose arrangement, in a multi-cylinder dryer in a paper machine, for the purpose of supporting the web, combined blow-suction boxes are employed, which have been fitted in the gaps between drying cylinders and which are provided with a plane wall at the inlet side of the drying wire and the web, a nozzle opening or openings being opened at the edge of the wall, by means of which opening(s) an ejecting flow is blown in the direction opposite to the direction of movement of the adjacent drying wire, by means of which ejecting flow a field of vacuum is induced in the gap space between said wall and the straight run of the drying wire and the web and in the following wedge space. The blow-suction boxes that are used include a suction and/or closing compartment, by whose means the free sectors at the top of the reversing cylinders between the adjacent wedge spaces have been covered. In said patent, a so-called box of a whole pocket is described, which fills substantially the entire pocket space while taking into account the necessary safety clearances.

It is a further object of the present invention to provide a solution in which, in the dryer section of a paper machine, the runnability is improved and, at the same time, the curl is controlled and the drying is enhanced, in particular in the dryer groups towards the final end of the dryer section.

It is an object of the present invention in particular to provide an arrangement which is suitable for use in connection with wires more open than usual at high running speeds of paper machines.

In a preferred embodiment of the method in accordance with the present invention, when the dry solids content of the web is higher than 60%, the web is dried through the wire by means of blowings produced by means of a blow box, by means of which blowings, on the straight runs of the paper web and the wire between the reversing cylinders or rolls and the drying cylinders, at the outlet side of the web and the wire, at the same time, the support contact between the paper web and the wire is enhanced in order to improve the runnability, and in the method a wire more open than usual is employed, whose permeability, i.e. penetrability to air, is 2000 . . . 20,000 $m^3/h/m^2$ and preferably 4000 . . . 10,000 $m^3/h/m^2$, in which case the drying of the web at the outlet side takes place both on the heated cylinder face of the drying cylinder and by means of drying blowings out of the blow box in view of controlling the tendency of curling of the web.

In a preferred solution of equipment of the present invention, blowings that dry the paper web have been fitted to be produced by means of a blow box at the outlet side, which blowings have been fitted to be blown towards the web through the wire, the permeability of said wire being 2000 . . . 20,000 $m^3/h/m^2$, and said blowings are applied to the web when its dry solids content has exceeded 60%.

According to an embodiment of the invention, in connection with dryer sections of paper machines that apply single-wire draw, a blow box or an equivalent runnability component is employed, by whose means, at the same time, improved runnability and control of curl and enhanced drying are achieved. The invention is applied in particular in the dryer groups towards the final end of the dryer section in a paper machine. The invention is applied in dryer groups in which the dry solids content of the paper web exceeds a desired limit value, for example, is higher than 60%, preferably 65%. The device in accordance with the invention comprises runnability nozzles and runnability/impingement drying nozzles, and in connection with the device in accordance with the invention, a drying wire is employed that is more open than normal, whose permeability is 2000 . . . 20,000 $m^3/h/m^2$, preferably 4000 . . . 10,000 $m^3/h/m^2$, in particular for paper machines at which high speeds are employed, for example 1000 . . . 2400 metres per min., preferably 1200 . . . 2000 metres per mm.

In the dryer groups in the initial part of the dryer section, most appropriately so-called blow boxes of a whole pocket space are used, which boxes are known, for example, from the applicant's said U.S. Pat. No. 4,905,380, and from the desired dry solids content onwards, blow boxes in accordance with the present invention are used. In accordance with a preferred embodiment of the invention, the runnability/drying blowings at the opposite side are continued over the drying cylinder as impingement-drying/through-drying blowings extending onto said cylinder, by means of which blowings the control of curl is enhanced further.

In accordance with the present invention, a system is provided for two-sided drying, in which, in the drying area proper, in which the necessity of curl control is also emphasized, thus, more open wires are used, which permit blowing through the wire, and at the same time a blow box in accordance with the present invention is used for the control of runnability and curl.

According to a preferred embodiment of the invention, in connection with the method in accordance with the invention and in connection with embodiments of equipment in accordance with the invention, as the drying fabric, a wire is employed whose face has been treated in order to improve the holding of the web in contact with the wire. Such a what is called sticky wire further ensures the keeping of the web on the face of the open drying wire. One such sticky wire is the wire marketed by Albany International with the product name Aerogrip™, and in respect of said wire reference is also made to the published EP Patent Application No. 0,761,872. A sticky wire can also be accomplished, for example, in compliance with the principles suggested in the U.S. Pat. No. 5,397,438 (equivalent to FI Patent 84,088).

By means of a blow box in accordance with the present invention, an efficient formation of a vacuum is produced at the inlet side by means of an ejection effect, and the nozzle that forms a vacuum at the opposite side, i.e. at the outlet side, also operates as a nozzle that enhances the drying of the web, which nozzle dries the web from the side opposite to the face dried by the cylinder face, whereby the curl of the web can be controlled. This blow face of the opposite side can also be brought as an extension of the box by means of a separate system of ducts, or a drying box or a chamber completely separate from the box at the opposite side can be formed.

Thus, at the inlet side, the device in accordance with the invention comprises a nozzle which blows in the direction opposite to the running direction of the web and which has been formed so that it blows into the opening passage in order to enhance the vacuum effect. The nozzles of the longitudinal direction can be provided separately with air ducts of their own. The blowings at the opposite side, or combinations of same, are formed so that they improve the runnability and enhance the drying of the web W, in which case, in the blowing, dry air is employed, and the blowing is preferably directed at the wire face, and the drying effect can be applied to the paper web through the wire that is more open than normally. When the device is composed of two separate boxes or chambers, at the inlet side preferably circulation air is used. The length of the blow face at the opposite side is not limited, but it may cover the cylinder over an area of up to 180°.

BRIEF DESCRIPTION OF THE DRAWINGS

In the following, the invention will be described in more detail with reference to the figures in the accompanying drawing, wherein.

DETAILED DESCRIPTION OF THE INVENTION

Figure 1:
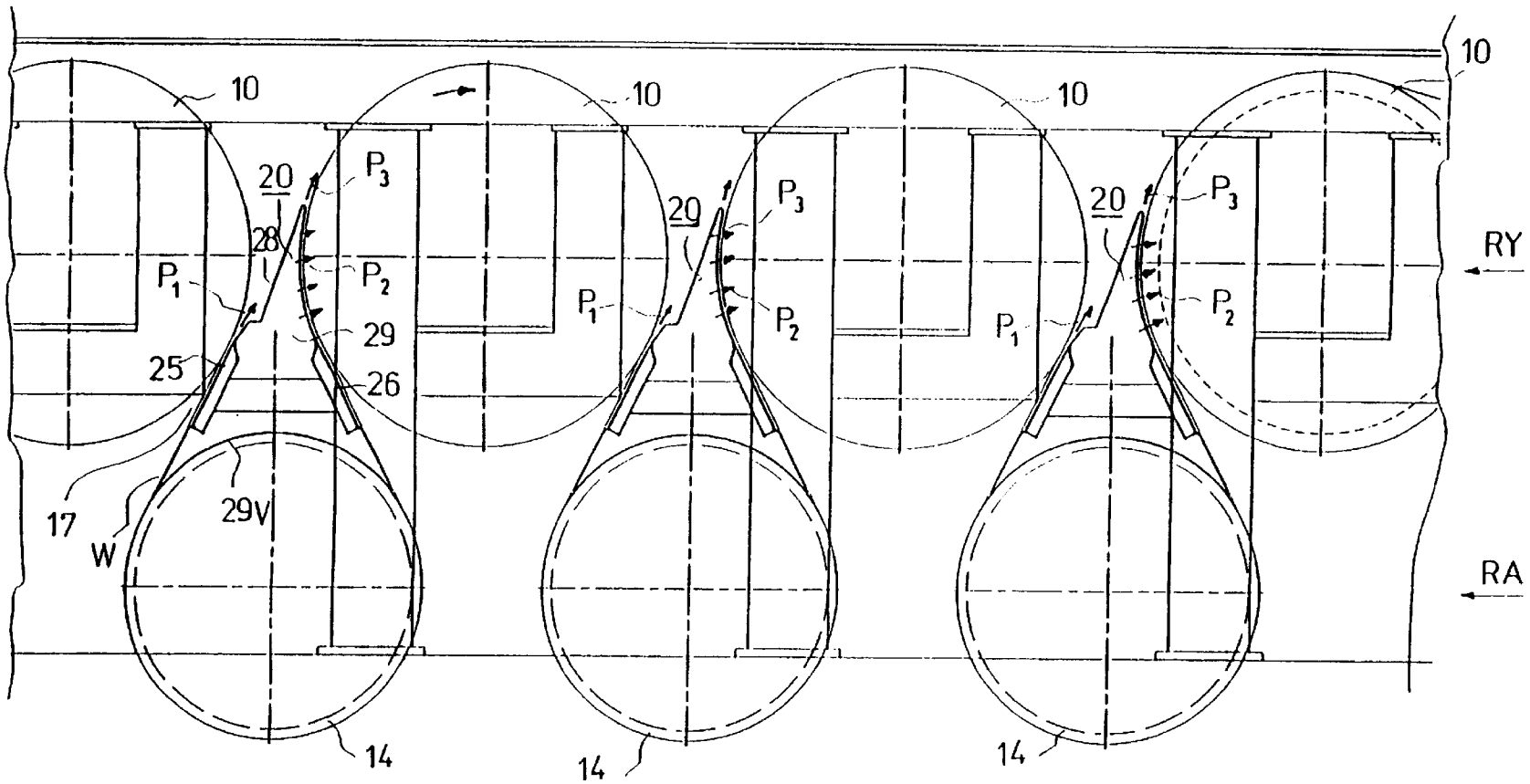
FIG. 1 is a schematic illustration of an embodiment of the present invention in an area of normal single-wire draw in the dryer section of a paper machine.
Figure 2:
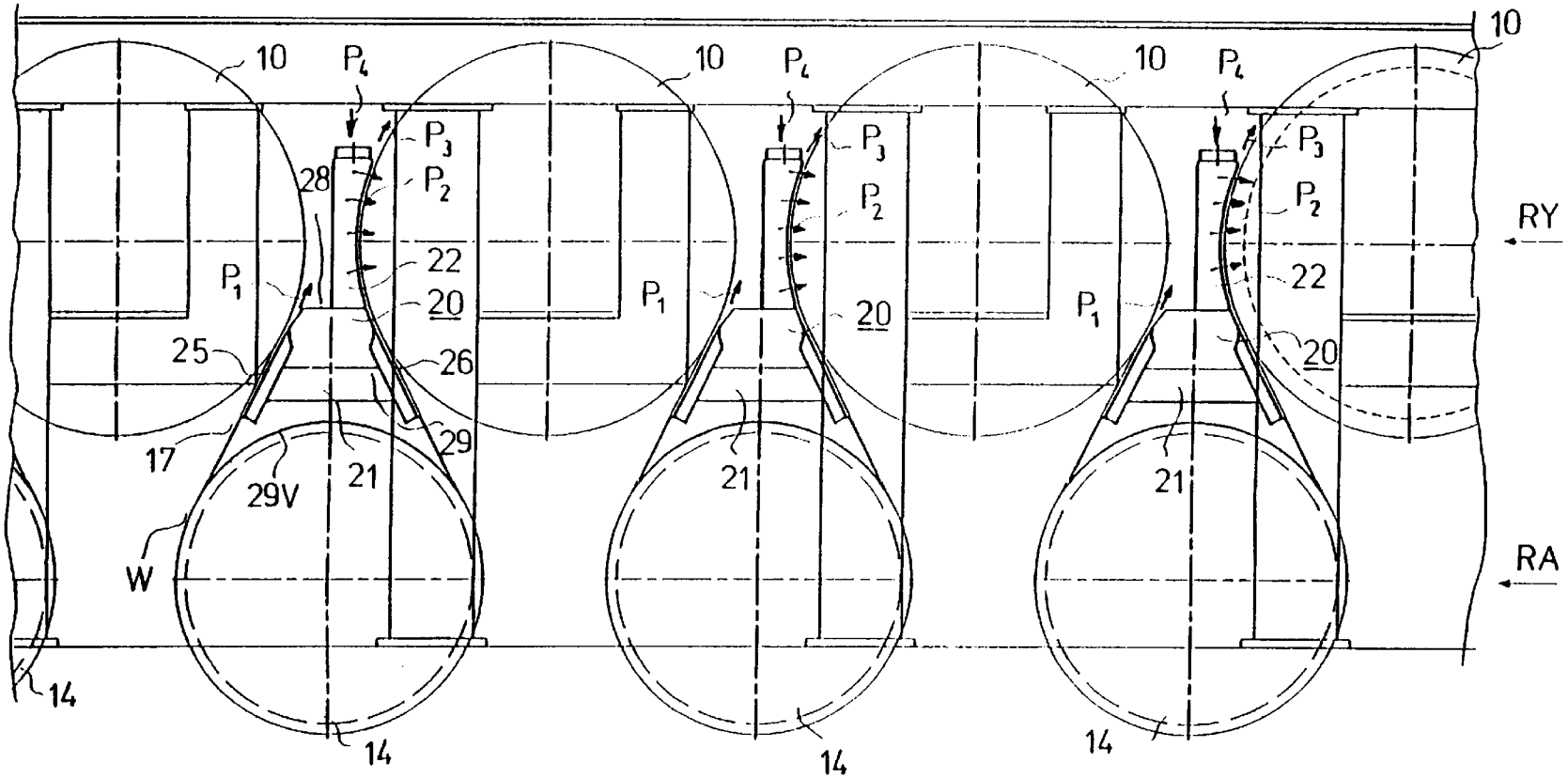
FIG. 2 shows a second embodiment in an area of normal single-wire draw in the dryer section of a paper machine.

In the dryer groups shown in FIGS. 1 and 2, of which there are schematic illustrations in part in the figures, in the upper row RY, there are steam-heated drying cylinders 10. On its outer face, the drying wire 17 carries the paper web W through the dryer group and presses the web against the heated faces of the cylinders 10 so that an evaporation drying effect is produced. Below the drying cylinders 10, in the lower row RA, there are non-heated reversing cylinders 14. On the reversing cylinders 14, the web W remains at the side of the outside curve on the outside face of the wire 17. On the reversing cylinders 14 the web W is kept reliably on support of the wire 17 against the effect of centrifugal forces by the effect of a vacuum present in the grooved face of the reversing cylinders 14 or on the perforated mantle of a corresponding suction roll, whereby shrinkage of the web W in the cross direction is also counteracted. As the reversing suction cylinders 14, particularly favourably the suction cylinders marketed by the applicant with the trade mark VacRoll™ are used, which cylinders have no inside suction box and in respect of whose construction details reference is made to the applicant's FI Patent No. 83,680 (equivalent to U.S. Pat. Nos. 5,022,163 and 5,172,491).

In accordance with the invention, the support contact of the web W and the drying wire 17 is kept adequate on the straight runs between the drying cylinders 10 and the reversing cylinders 14 by, on the runs taking place from the drying cylinders 10 to the reversing cylinders 14, employing blow-suction boxes 20, by whose means a vacuum is produced on both of said free wire runs and even in the whole pocket space and, in particular, formation of pressures induced by the wire 17 and by the roll 14 is prevented in the closing wedge-shaped nip spaces between the wire 17 and the mantles of the reversing cylinders 14. Thus, the blow suction boxes 20 are understood as blow boxes at which the blowing of air produces a vacuum, and said boxes 20 are not connected to sources of vacuum.

The groups of drying cylinders shown in FIGS. 1 . . . 2 are dryer groups placed towards the final end of the dryer section in the paper machine. Before/after the parts of dryer groups shown in FIGS. 1 . . . 2, in the dryer section, there can be one or several groups with single-wire draw similar to those shown in the figures. Of course, a dryer section can also include dryer groups of other types or parts of same.

As is shown in FIGS. 1 . . . 2, in the pocket spaces in the gaps between the drying cylinders 10 and the reversing cylinders/rolls, there are combined blow-suction boxes 20, by whose means the free sectors at the top of the reversing cylinders 14 are covered as completely as is permitted by safety clearances. The blow-suction boxes 20 comprise an upper wall 28, a lower wall (not shown in the figure), and side walls 25 and 26 as well as end seal walls 29, which have a curved lower edge 29V following the outer face of the mantles of the cylinders 14, which lower edge 29V is placed at the distance of the gap V from the mantle 18.

In the embodiment as shown in FIG. 1, in the pocket spaces placed between the drying cylinders 10 in the upper row RY and the reversing rolls or cylinders 14 placed in the lower row RA as interlocking with the drying cylinders, which pocket spaces are partly defined by the wire 17, there are blow-suction boxes 20, in which the blowing $P_1$ at the inlet side is an ejection blowing, by whose means the vacuum effect is enhanced in order to improve the runnability, and at the outlet side, drying blowings $P_2$ are blown out of the box 20 towards the cylinder 10 face, which blowings $P_2$, at the same time, improve the runnability. The wire 17 is more open than usual, in which case the drying of the web W takes place both by means of the heated cylinder face and by means of the blowings $P_2$. In this exemplifying embodiment, the blow box 20 has been formed as a single unit. The side wall 26 of the box 20 at the outlet side complies with the face of the adjacent cylinder 10 at the distance of the necessary safety clearance. From direct vicinity of the bending point between the side wall 26 and the top wall 28, a runnability/drying blowing $P_3$ can be blown in the running direction of the web W.

In the embodiment as shown in FIG. 2, the blow-suction box 20 is composed of two chambers 21, in which case, in order to produce the runnability blowing $P_1$, circulation air can be employed, and for the drying blowings $P_2$ there is a blow chamber 22 of their own, which can also extend over the drying cylinder 10 as an impingement-drying/through-drying unit on the desired covering angle, e.g. 120°, even up to 180°. The chamber 22 may also extend down to the bottom wall. Into the chamber 22, dry air is passed for the drying/runnability blowings $P_2$ and for the drying/runnability blowing $P_3$ as a flow $P_4$ along a duct (not shown).

Figure 3:
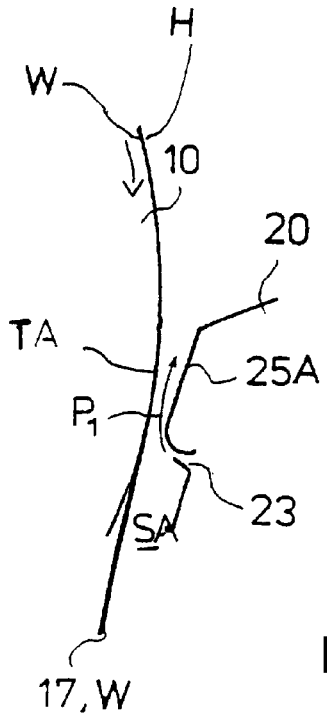
FIG. 3 is a schematic illustration of an inlet-side blow nozzle embodiment.

FIG. 3 shows the nozzle 23 of the ejection blowing $P_1$ at the inlet side, which nozzle is opened into a pass-like space TA between the nozzle wall 25A of the box 20 and the adjacent cylinder 10. The blowing $P_1$ produces a vacuum in the space SA.

Figure 4:
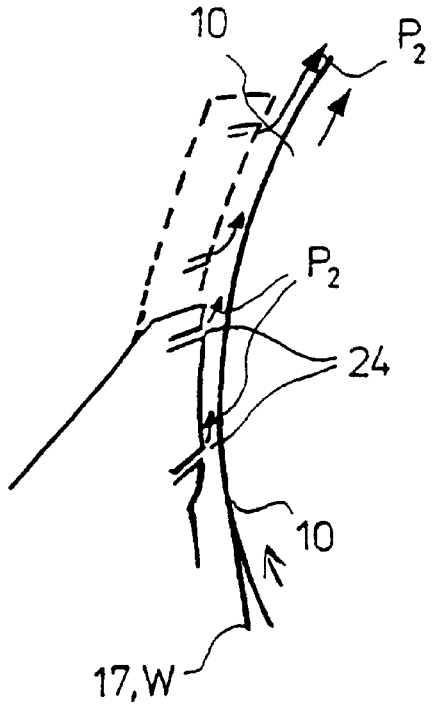
FIG. 4 is a schematic illustration of an outlet-side blow nozzle embodiment.

FIG. 4 shows the production of the runnability and drying blowings $P_2$ at the outlet side by means of nozzles or holes 24 of direct blowing.

Figure 5A:
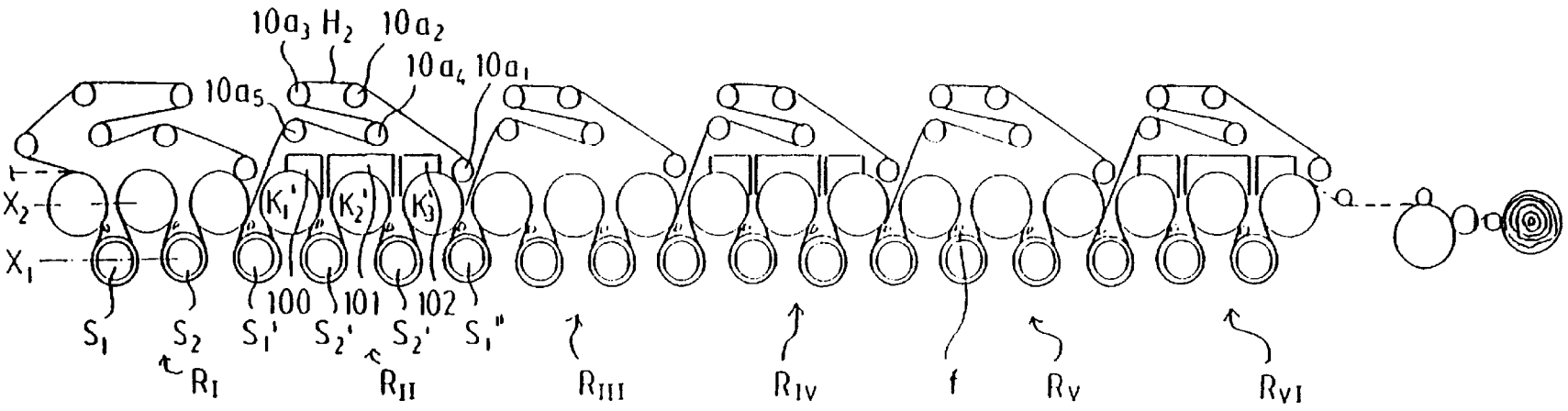
FIG. 5A shows a dryer section concept in accordance with the invention, in which the inverted groups have been substituted for by groups provided with impingement drying units, in which groups the running of the wire/web is in the other respects the same as in a conventional group, but in which the drying cylinders are provided with impingement drying units.

FIG. 5A illustrates a preferred dryer section concept in accordance with the invention, in which, as an example, there are six groups of drying cylinders, i.e. the groups $R_I$ . . . $R_{VI}$. In the concept of this figure, every second group is a group of drying cylinders provided with an impingement drying unit. In FIG. 5A, a group $R_{II}$, is shown, in which there is a wire draw $H_2$ and in which the wire is passed over alignment-rolls onto the first suction roll $S_1$ placed in the lower plane RA, and from said VacRoll onto the heated drying cylinder $K_1'$ placed in the upper horizontal plane RY, which cylinder includes an impingement drying unit above the cylinder, through which unit drying medium, preferably heated air or superheated steam, is passed through the wire onto the web W.

In FIG. 5A, in the group $R_{II}$, the impingement drying unit 100 is placed in the group of drying cylinders on the drying cylinder $K'_1$ at the top of the first drying cylinder $K'_1$. In the group $R_{II}$, the wire and the web run onto the lower reversing roll, preferably a suction roll $S'_2$, and from the suction roll back onto the drying cylinder $K_2$ placed in the plane RY, which cylinder $K_2$ is provided with an impingement drying unit 101 placed on a sector of 180°. In such a case, drying medium is passed into connection with the web W on a sector of 180°.

From the drying cylinder $K'_2$ in the group $R_{II}$, of drying cylinders, the web and the wire are passed, meandering in loop shape, onto the reversing roll $S'_2$ and from the reversing roll $S'_2$ again onto the heated drying cylinder $K'_3$ placed in the plane RY, which cylinder is provided with an impingement drying unit 102 placed on an inlet sector of 90°. The reversing rolls $S_n$,$S_{n+1}$ . . . are preferably suction rolls, which are provided with perforations passing through the mantle. They may be provided with a suction box placed in the interior of the mantle, or they may be rolls with no suction box in the interior, for example rolls of the VacRoll type. They may also be reversing rolls into whose circumferential grooves a vacuum is produced out of the pocket space, out of a suction box that is placed in the pocket space and that produces a vacuum. An embodiment is also possible in which the vacuum is applied to the interior of the roll through perforations passing through the roll into the pocket space by means of a suction box or by means of a corresponding construction that produces/transfers a vacuum. In such a case, the roll itself is free from suction boxes and comprises a perforation through the mantle. Thus, as is shown in FIG. 5A, all the drying cylinders $K'_1$ . . . $K'_3$ in the group $R_{II}$ are provided with impingement drying units, the first drying cylinders $K'_1$ being provided with impingement drying devices on a sector of 90° on the latter outlet half of about 90° of the covering area of the drying cylinder. On the middle drying cylinder $K'_2$ there is an impingement drying unit on almost the whole covering area, i.e. on a sector of about 180°, and on the last drying cylinder $K'_3$ the impingement drying unit is placed on a 90° inlet sector.

The web W is passed from the drying cylinder $K'_3$ into the next group $R_{III}$ onto its first reversing roll, preferably a suction cylinder (VacRoll) $S_1''$, and over said VacRoll onto the drying cylinder $K_1''$ placed in the plane $X_2$ and further in the conventional way in the group $R_{III}$ with single-wire draw. The group $R_{III}$ does not include impingement drying units. The next group $R_{IV}$ again comprises impingement drying units in accordance with the invention, similarly to the group $R_{II}$. Thus, in connection with a transfer from group to group, an inverted group and one-sided drying have been replaced by impingement drying.

In a dryer section as shown in FIG. 5A, it is also possible to employ prior-art blow or suction boxes (f), for example blow boxes marketed by the applicant with the trade name UnoRun Blow Box, in order to secure an undisturbed run of the web along with the wire from a cylinder onto a lower roll.

Figure 5B:
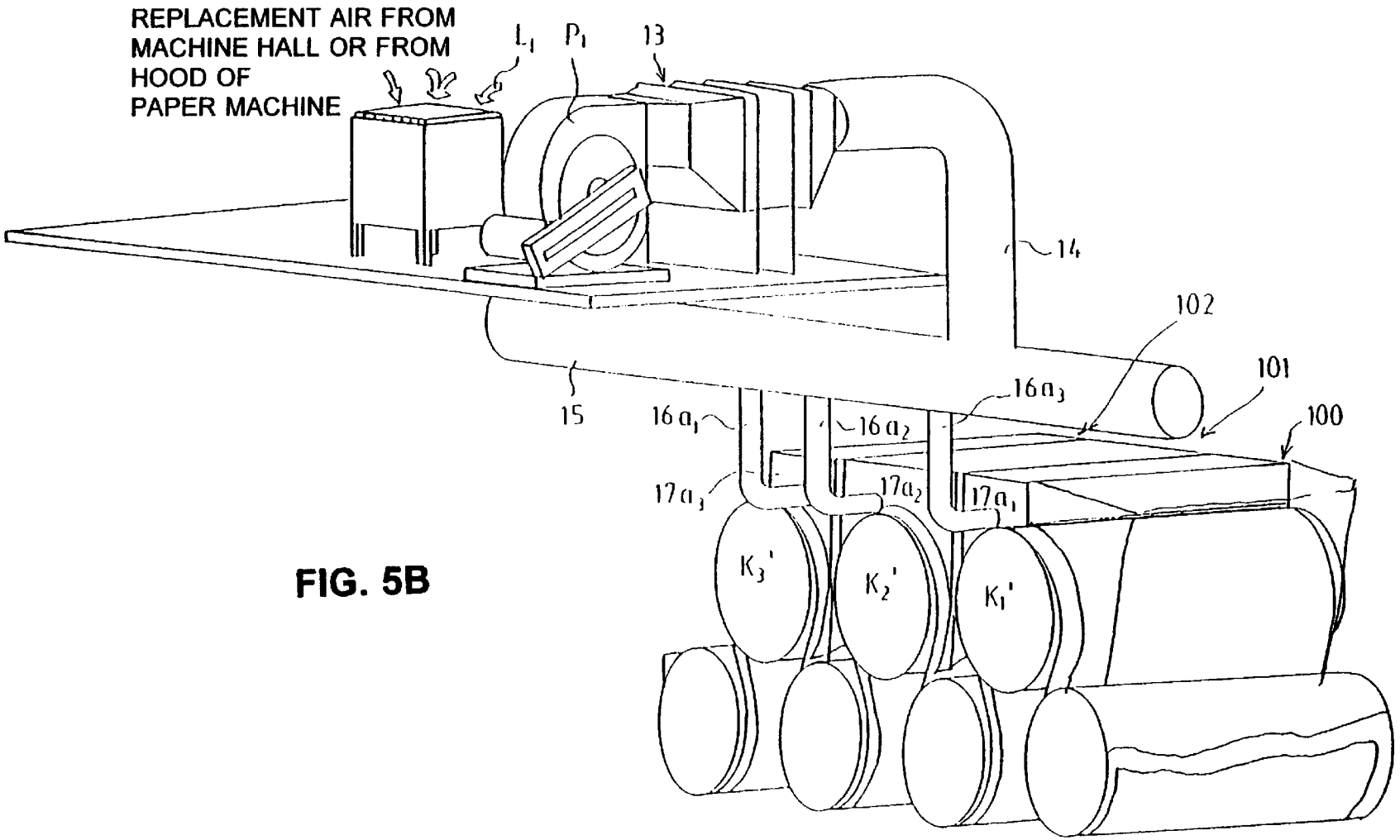
FIG. 5B is an axonometric view of an impingement drying group in accordance with the present invention as a separate illustration.

FIG. 5B illustrates the introduction of the heating medium into the group $R_{II}$ shown in FIG. 5A. Out of the pipe 150, hot heating medium is passed through the branch ducts 160$a_1$, 160$a_2$ and 160$a_3$ into the boxes or hoods 170$a_1$, 170$a_2$ and 170$a_3$ of the impingement drying units 100,101, 102 extending across the width of the cylinders. Through the boxes, the heating medium is distributed uniformly into connection with the wire and through the wire into connection with the web W, which is placed in contact with the heated drying cylinder $K_1'$,$K_2'$,$K_3'$. In the embodiment shown in FIG. 5B, the drying medium, such as superheated steam or heated air, is passed into the boxes 170$a_1$, 170$a_2$ . . . and further through the discharge face of heating medium in said boxes into connection with the wire H and through wire onto the web W. In the embodiment shown in FIG. 5B, there is no separate exhaust duct, but the heating medium that has been passed to outside the hood is passed from the interior of the hood of the paper machine out through the circulation of air.

In the embodiment shown in FIG. 5B, the air is taken from the paper machine hall or from the hood of the paper machine in the way illustrated by the arrow $L_1$, being made to flow by means of a centrifugal blower $E_1$ into a heating unit 13, which may be a heat exchanger construction, in which air is heated, for example, by means of steam or by means of a separate burner. In the figure, the heated air is transferred from the duct 14 further into the duct 15 and from it into the branch ducts 16$a_1$, 16$a_2$ . . . and further into the impingement drying units 100,101,102 . . . In the embodiments shown in FIGS. 5A . . . 5D, the hood R intended for passing of the impingement drying medium also extends into the pocket space F in respect of its portion R", which pocket space is formed between the drying cylinders $K_n$,$K_{n+1}$, the reversing roll and the roll $S_n$ placed below said rolls. In the solution shown in FIG. 5B, besides as impingement drying air, air is also introduced for an air flow $P_1$,$P_3$ that supports the run of the web to the portion of the run of the web that is not supported by the wire. Said jets $P_1$,$P_3$ produce a vacuum in the space between the hood R and the wire, by means of which vacuum a suction effect is applied to the web W through the wire, and the web is kept in contact with the face of the wire H.

Figure 5C:
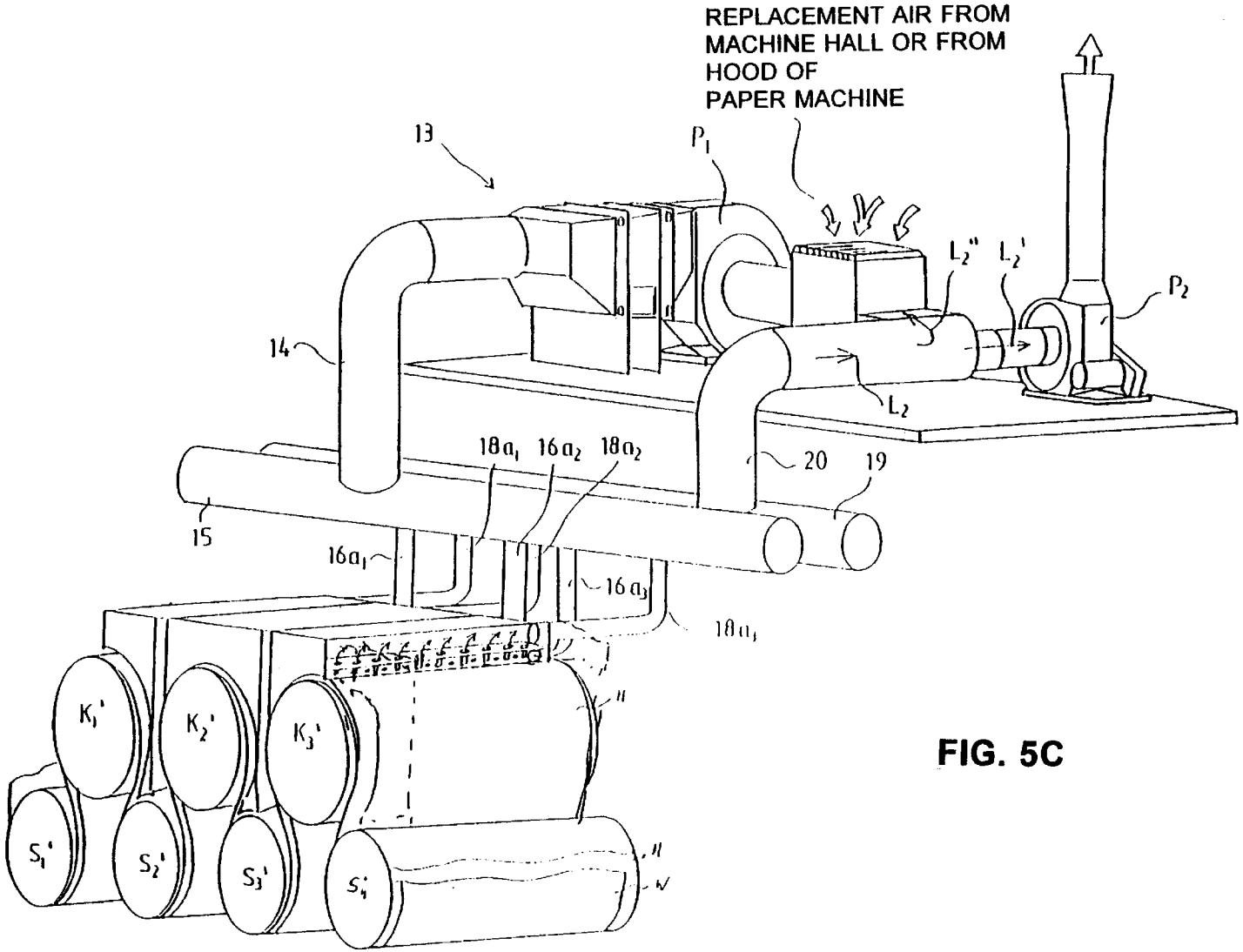
FIG. 5C shows a second embodiment of the introduction of the heating medium.

FIG. 5C shows an embodiment of the invention that is in the other respects similar to FIG. 5B, but in the solution of FIG. 5C, removal of the impingement drying medium from the interior of the unit 100,101 . . . has also been arranged. As is shown in FIG. 5C, impingement drying or heating medium is additionally removed from the interior of each unit 100,101,102 through the ducts 18$a_1$, 18$a_2$, 18$a_3$ into a collecting duct 19 and from it further into the duct 20 in the way indicated by the arrow $L_2$. Said exhaust air or steam can be circulated in the way indicated by the arrow $L_2$" through the blower $E_1$ into the duct 14, or said exhaust air flow that has been passed into the duct 20 can be passed by means of the blower $E_2$ directly out of the equipment.

A part of the air that has been passed into the duct is passed to the end of the hood R and further into the pocket space F as a support/suction/prevention air that improves the runnability, in which connection the operation is similar to that illustrated in the embodiment shown in FIG. 5B. The air jets $P_1$ and $P_3$ are passed into the pocket space F onto the straight portions of the web/wire run and as parallel to them.

Figure 5D:
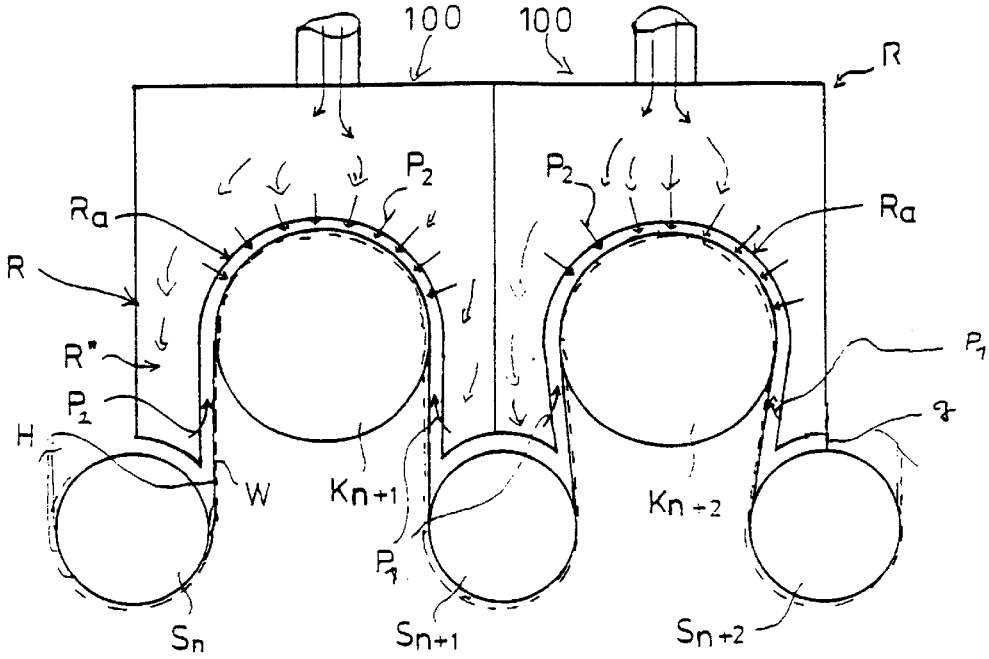
FIG. 5D is a detailed illustration of the construction shown in FIG. 5B.

FIG. 5D shows a preferred embodiment of the hood R, which can be applied, for example, in the embodiment shown in FIG. 5B. In FIG. 5D, two units 100 are shown. Each unit 100 comprises a hood R, which extends into the pocket space F between the drying cylinders $K_n$,$K_{n+1}$ and the suction roll $S_n$. As is shown in FIG. 5D, the impingement drying medium $P_2$ is passed through a highly permeable wire H into connection with the web W, and a part of the impingement drying air is passed through the interior of the hood R into the lower pocket space F shown in the figure, into which a portion R" of the hood R extends. From said portion R" of the hood R, a medium jet $P_1$ is produced along with the wire and, thus, a vacuum is produced, whereby the web W is kept on the face of the wire also on the run of the web on which the wire H does not support the web W. In the embodiment shown in FIG. 5D, in the end part R" of the hood R, there are means that produce an ejection jet $P_1$, through which means the run of the web W is supported at the outlet side of the suction roll $S_n$ by producing a suction hold of the web W on the wire face. By means of said jets, air is also removed from the pocket space F. As is shown in FIG. 5D, the solution of equipment also includes means that produce an ejection jet $P_1$ at the outlet side of the pocket space F in the second hood R, by means of which means entering of excessive air between the hood R and the wire H is prevented, and by whose means air is removed out of the pocket space F. In the embodiment shown in FIG. 5D, the hoods R of the adjacent units 100 form a unit fitting together, in which case the pocket space F is fully closed outwards with no access of outside air.

Figure 5E:
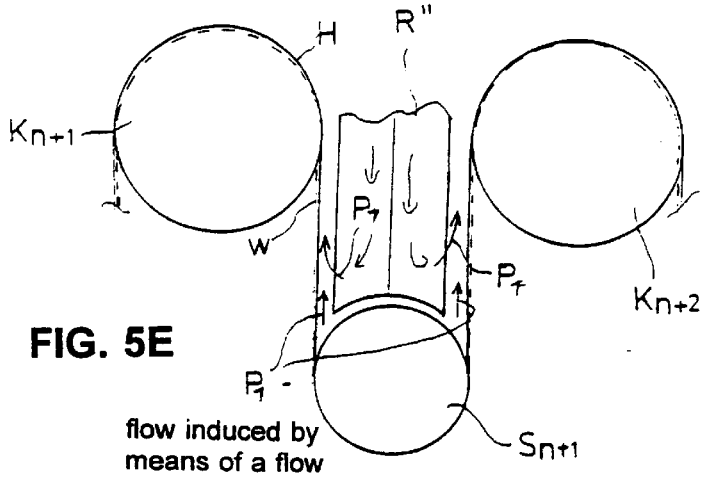
FIG. 5E illustrates the operation of the frame portion of the hood that extends into the pocket space as a construction component that stabilizes the web, through which frame portion the jets of medium, preferably air jets, are supplied in order to remove air out of the pocket space/to stabilize the running of the web and to keep the web in contact with the wire face/to prevent access of air into the pocket space.

As is shown in FIG. 5E, the jets $P_1$ operate, besides as curtain jets, also as jets that induce an air flow out of the pocket space F. The function of the jets $P_1$ is to prevent access of an air flow into the pocket space F, and they remove air out of the pocket space F, i.e. they induce an exhaust air flow on the straight portions of the run of the web. In such a case, additionally, they produce a vacuum, by whose means the web W is kept in contact with the wire H.

Figure 6A:
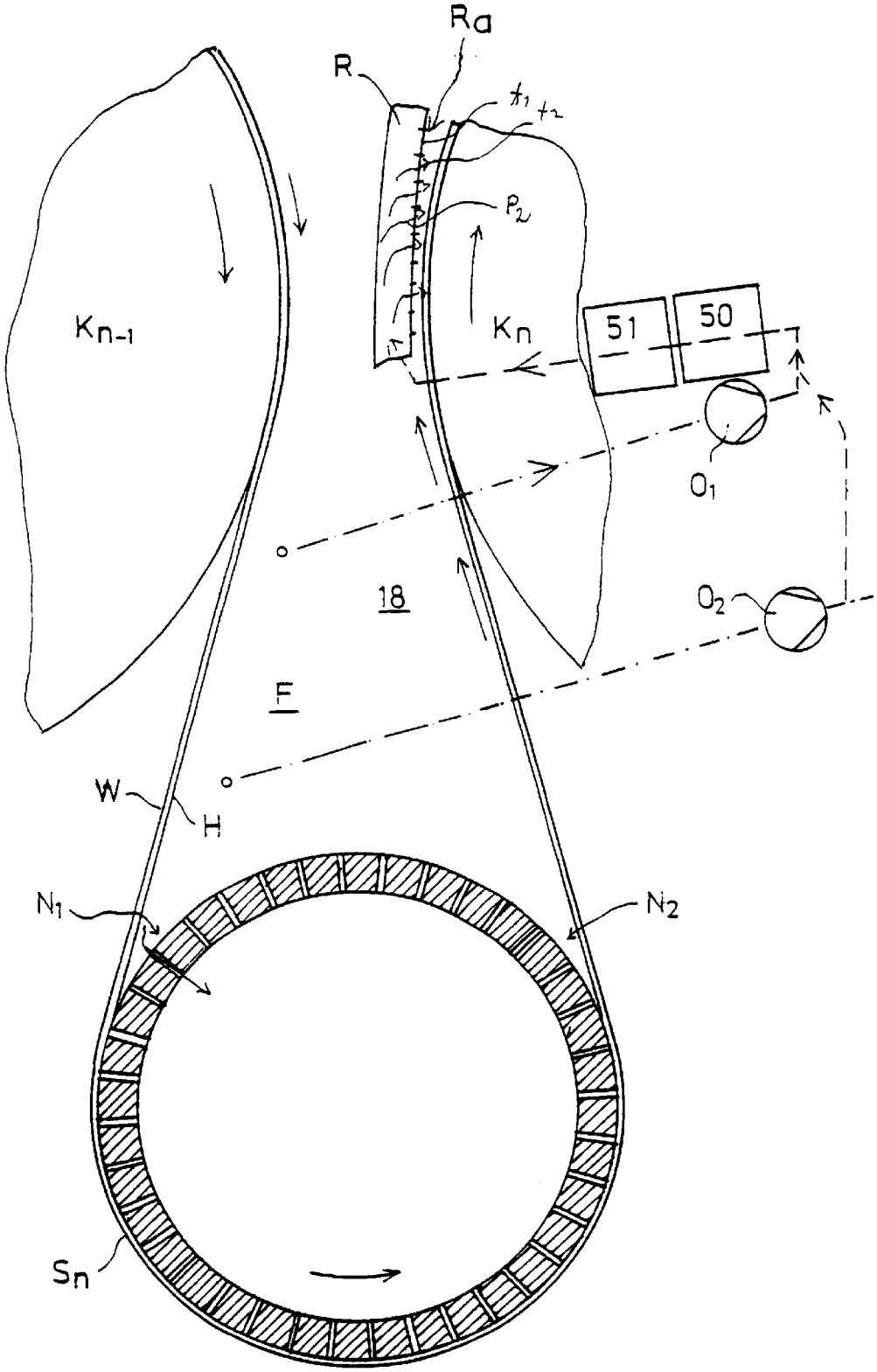
FIG. 6A shows a solution of equipment in accordance with the invention, in which the equipment comprises suction devices by whose means, on the whole, carriage of air is prevented in the pocket F into the nip between the wire and a suction cylinder.

In the embodiments of the invention shown in FIGS. 6A . . . 6C, the construction is related to a dryer section and to a single-wire draw in which the web W runs along the face of the drying cylinder $K_{n-1}$ between the wire and the face of the drying cylinder, and the web is passed further onto the reversing roll $S_n$. The reversing rolls $S_n$ can be suction rolls of the VacRoll type, in which case they include no suction box in their interior. In such a case, a vacuum is sucked into the space in the interior of the roll and applied through the perforations in the roll mantle to outside the roll. In such a case, the bores passing through the roll mantle may terminate in grooves, which run on the mantle face, being preferably circumferential grooves. The reversing rolls $S_n$ can also be rolls provided with a suction box, which rolls comprise perforations passing through the roll and an inside suction box. The rolls may also be grooved rolls, in which case suction is produced in the grooves by means of the exhaust suction produced by the suction box fitted in the pocket space. At the reversing roll $S_n$, the web W runs outermost on the face of the wire H and further onto the second drying cylinder $K_n$. The drying cylinders $K_{n-1}$, $K_n$ . . . are steam-heated drying cylinders, and, in the way described above, the reversing roll $S_n$ can be a roll of the VacRoll type, through whose mantle perforations pass, which terminate preferably in annular grooves. In such a case, by means of a vacuum produced in the interior of the reversing roll $S_n$, the web W is kept in contact with the wire face also at the reversing roll $S_n$, at which the web runs outermost.

In the following FIGS. 6A . . . 7D, some preferred embodiments of the invention are illustrated and described. Impingement drying jets for drying of the web W (board/paper) are denoted with the reference arrows $P_2$, and runnability jets for supporting the web W and for improving the runnability are denoted with the reference arrows $P_1$,$P_3$. The hood R in accordance with the invention, through which the impingement drying medium and runnability medium, such as air, is passed, is a box-like construction which extends across the entire machine width.

FIG. 6A shows a solution of equipment in which air is sucked from the interior of the pocket space F, preferably so that the intake sides of the suction means $O_1$, $O_2$, preferably blowers, are connected to the pocket F between the drying cylinder $K_{n-1}$, the suction roll $S_n$, and the drying cylinder $K_n$, preferably to the vicinity of the nip $N_1$ at the inlet side of the suction roll $S_n$.

As is shown in FIG. 6A, the intake sides of the blowers $O_1$ and $O_2$ are connected to the pocket space F so that, by means of said blowers, air is removed out of the pocket space F as suction, and the ducts at the output side of said blowers $O_1$ and $O_2$ have been fitted to pass through conditioning units 50,51, by whose means said air is dried and/or heated and passed through the perforated face $R_a$ or equivalent of the hood R into connection with the drying cylinder $K_n$, The perforated face $R_a$ is fitted to be curved along the drying cylinder. Thus, in the solution of equipment shown in FIG. 6A, air in the pocket space F is utilized. First, the pocket space is stabilized so that fluttering does not arise in the web W, and the air in the pocket space is utilized further so that it is passed through drying and/or heating as impingement drying air into connection with the drying cylinder $K_n$ so as to dry the web and to increase its dry solids content and/or to control its tendency of curling.

Figure 6B:
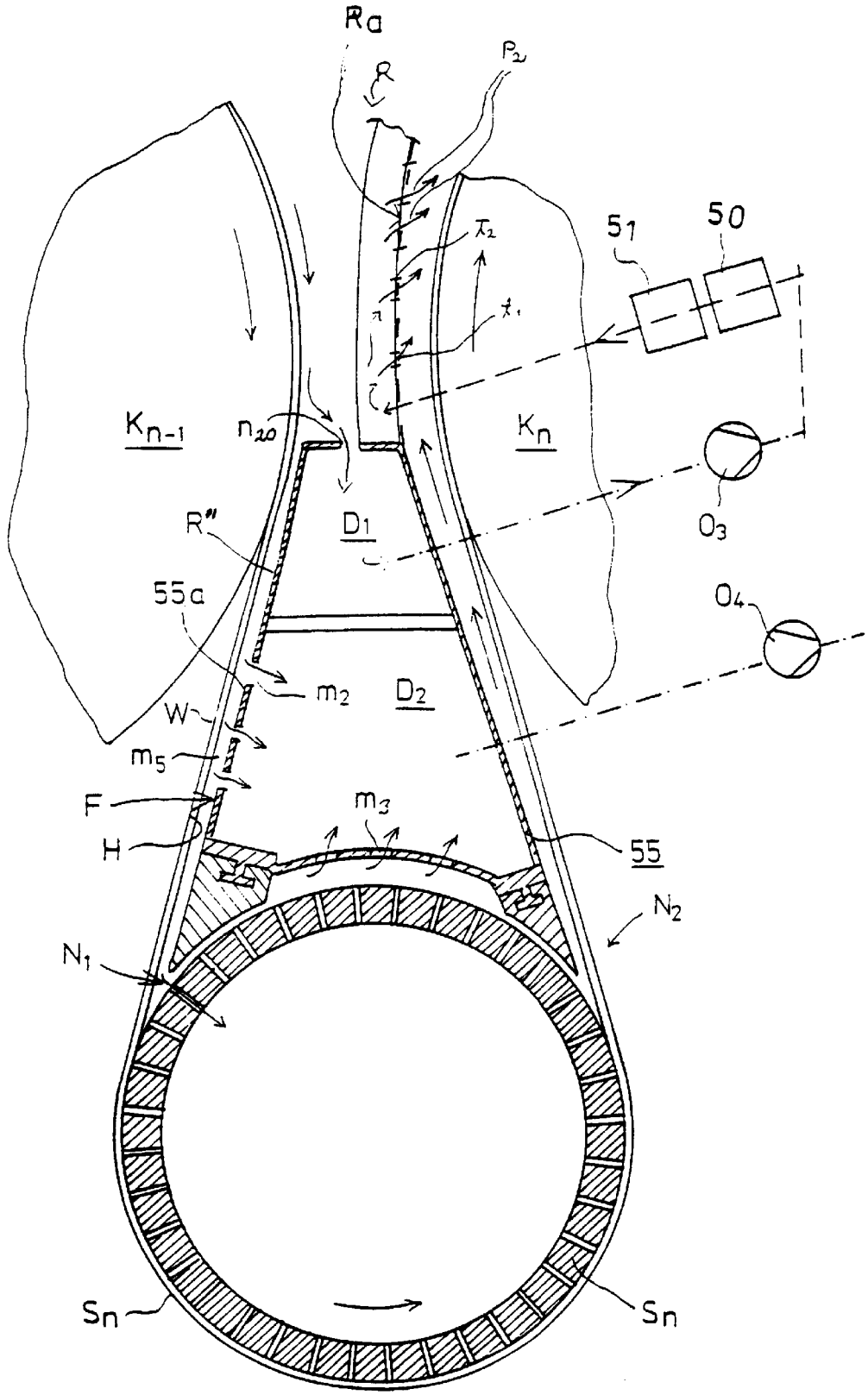
FIG. 6B shows a solution in which the closing frame, i.e. a so-called closing block, comprises suction devices, by whose means air is sucked from the interior of the block out of the suction chambers, into which it is sucked from between the block and the wire as well as from the front side of the block.

In the embodiment shown in FIG. 6B, by means of a blower, a vacuum pump or an equivalent $O_3$ device, a vacuum is produced in the space $D_1$ inside and at the top in the hood R. Through the opening $n_{20}$ provided in the top portion of the space $D_1$ at the top of the hood R, air is sucked out of the space between the drying cylinders $K_n$ and $K_{n-1}$, and thereby access of air into the inlet-side nip $N_1$ between the suction roll $S_n$ and the wire H is prevented, at which nip the air would produce a pulse of pressure and, thereby, fluttering of the web W. The embodiment of the invention also comprises a second blower, pump or an equivalent device $O_4$, by whose means a vacuum is produced in the other space $D_2$ inside the hood R, and by means of the vacuum air is sucked through the opening $m_2$ in the hood R out of the space between the straight surface portion 55*a* and the wire H into the space, i.e. compartment $D_2$ and further out of said compartment. Into the space $D_2$, air is also sucked by means of the pump $O_4$ from above the reversing roll $S_n$ through the perforations $m_3$ provided in the curved perforated face of the hood R.

If the reversing roll $S_n$ is a suction cylinder, a vacuum is sucked into its interior through the perforations $m_3$ in the hood R. In this embodiment, the chamber $D_4$ may be provided with the perforations $m_3$ only, with no lateral perforations $m_2$.

In the solution of equipment of FIG. 6B, by means of the pump $O_3$, the air that has been sucked through the opening $m_1$ is blown further through a possible drying unit 50 and/or heating unit 51, if any, and further through the perforated face Ra or through a corresponding face placed in compliance with the roll $K_n$ as impingement drying $P_2$ through the wire H into connection with the web W so as to dry the web and/or to control its tendency of curling. The impingement drying $P_2$ takes place through the perforated face Ra of the hood R.

Figure 6C:
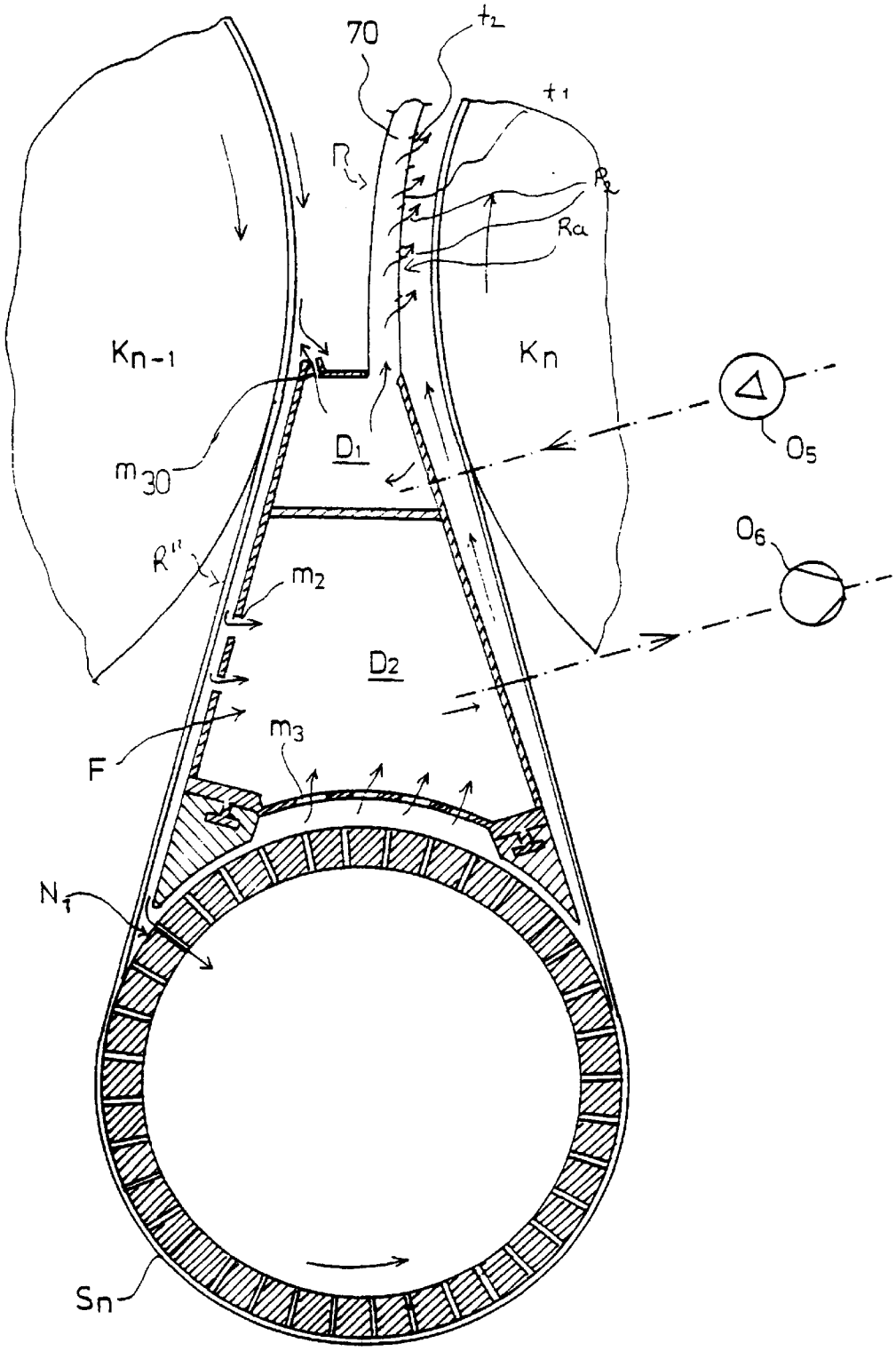
FIG. 6C shows a solution in which a curtain jet is used in order to prevent access of air into the space between the closing block and the wire. Further, the solution of equipment comprises a suction chamber, by whose means air is sucked from between the side face of the block and the wire.

FIG. 6C shows an embodiment of the invention in which blowing is passed into the interior space in the hood R, i.e. into the compartment $D_1$, by means of a blower $O_5$. Out of the space in the interior of the frame 55, i.e. out of the second compartment $D_2$, air is sucked by means of a pump $O_6$ out of the space between the straight face 55*a* of the frame 55 and the wire H through the opening $m_2$ provided in the side face 55*a* of the frame 55, as was the case in the preceding embodiment, or also from the top of the reversing roll $S_n$ through the openings $m_3$.

In the embodiment of FIG. 6C, the air is blown out of the compartment $D_1$ to constitute impingement drying air and closing air. Thus, the air blown into the compartment $D_1$ is guided as a sealing/curtain jet into the pocket space F to the inlet side through the opening $m_{30}$ in the hood R, as well as to constitute impingement drying air, in which case the air is first made to flow into the passage 70 and from the passage 70 through the nozzle openings $t_1$,$t_2$ . . . or equivalent in the air discharge face Ra into connection with the wire H and further with the web W. The passage 70 is opened into the space $D_1$.

Within the scope of the embodiment shown in FIG. 6C, it is also possible to employ the air that has been sucked into the compartment $D_2$ as impingement drying air.

Within the scope of the present invention, an embodiment is also possible in which the reversing roll $S_n$ is just a roll with a grooved face, which does not include perforations passing through the mantle. In such a case, the vacuum is produced into the grooves by means of the equipment shown in FIGS. 6B and 6C. In the chamber space in the hood R, i.e. in the compartment $D_2$, a vacuum is produced, and air is sucked into said space out of the grooves of the non-perforated reversing roll $S_n$. Thus, the grooves are subjected to a vacuum, and by means of said arrangement the web W is kept in contact with the wire H face also on the runs of the web on which the web W is placed at the side of the outside curve.

Figure 7E:
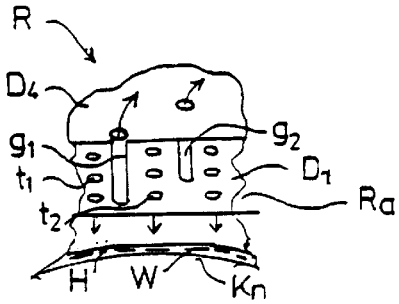
FIG. 7E is a schematic illustration of an embodiment of the invention in which, through a separate perforated face or equivalent, impingement drying air is applied to the wire face and through the wire into connection with the web in connection with the drying cylinder, and in which air is removed from the face of the wire through separate exhaust ducts or pipes and said air is transferred into an exhaust chamber and further through the chamber out of connection with the construction.
Figure 7A:
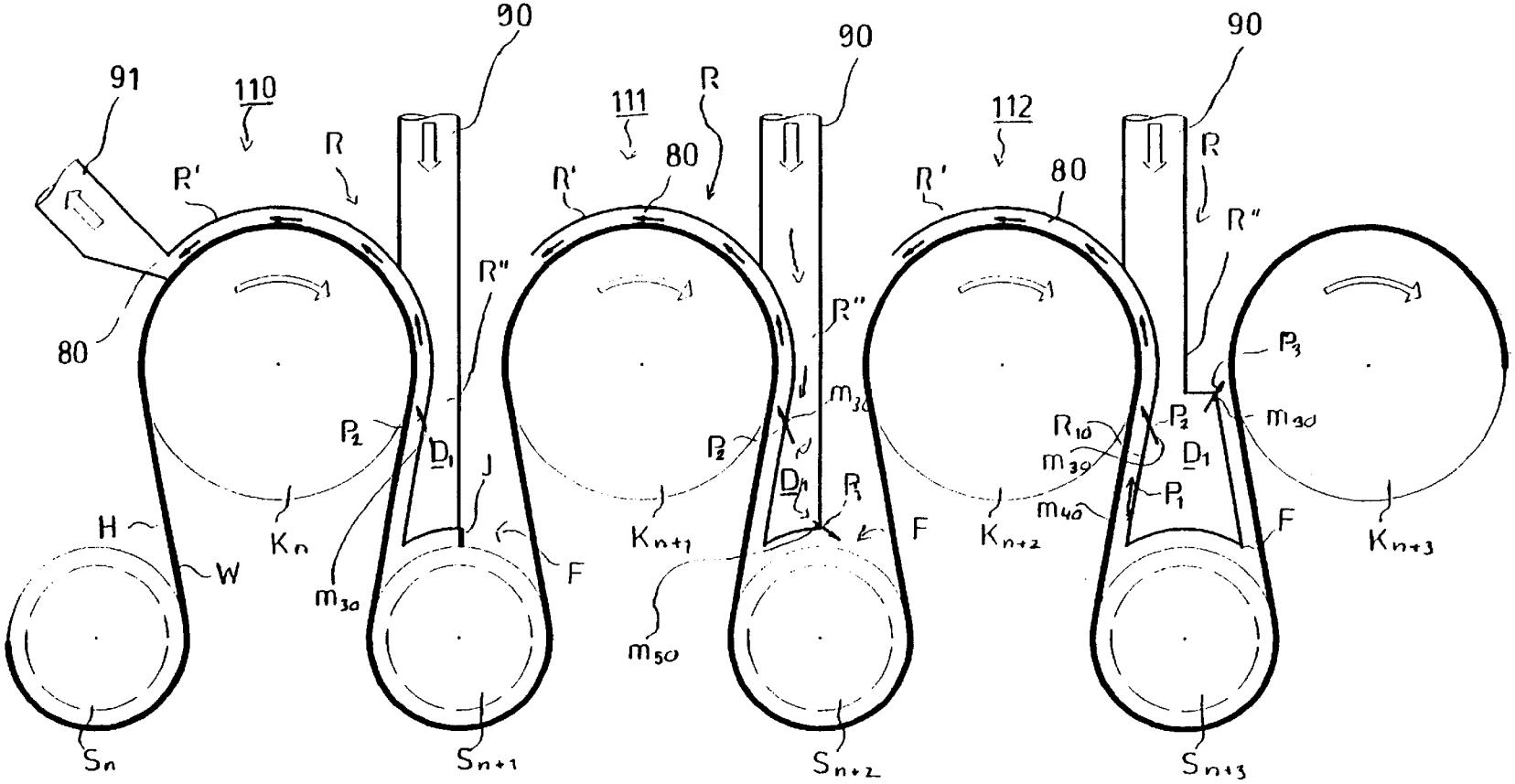
FIGS. 7A . . . 7D are schematic illustrations of preferred embodiments of the invention.

In the embodiment of the invention shown in FIGS. 7A . . . 7D, the hood R is a box-like construction which extends across the machine width. The chamber space or compartment in the interior of the hood R is denoted with the reference $D_1$.

FIG. 7A shows an embodiment in which air is made to flow into the frame part R" of the hood R, extending into the pocket space F. Air is made to flow out of the frame part R" into the space 80 between the curved face R' of the frame part and the wire H and, in the direction opposite to the sense of rotation of the drying cylinder, further in said annular passage 80. As is shown in the figure, the impingement-drying/runnability units 110,111,112 have been fitted in connection with the drying cylinders $K_n$,$K_{n+1}$ . . . and the pocket spaces F between said cylinders. As is the case also in the preceding embodiments, the web is passed in connection with the dryer section so that, in connection with the reversing rolls $S_n$,$S_{n+1}$, the web runs outermost, in which case the reversing rolls $S_n$,$S_{n+1}$ are preferably suction rolls. In connection with the drying cylinders $K_n$,$K_{n+1}$ . . . , the web W runs in contact with the faces of the drying cylinders, and the wire H runs outermost. The permeability of the wire H shown in FIG. 7A is similar to the values stated above, i.e. the permeability is in the range 2000 . . . 20,000 $m^3/h/m^2$ (cubic metres per hour per square metre), and preferably 4000 . . . 10,000 $m^3/h/m^2$. The frame R, which is also called hood in the present patent application, comprises an intake duct 90 in each of the units 110,111,112, and in the unit 110 there is also an exhaust duct 91. Drying medium, preferably air or steam, is passed into the interior of the hood R into the space $D_1$ through the duct 90 in the way illustrated in the figure, and out of the frame part R" of the hood R extending into the pocket space F, the medium is passed through the duct opening $m_{30}$ in the hood along the annular passage 80 between the curved portion R' of the hood R and the drying cylinder $K_1$ into the exhaust duct 91. For example, in connection with the unit 110, it is possible to circulate the air from the passage 80 into the duct 91 and further, through a blower not shown, back into the duct 90, preferably through drying/heating.

As is shown in FIG. 7A, the second unit 111 comprises a mechanical seal J on the hood portion R" of the hood R extending into the pocket space F. The seal is placed between the hood R portion R" and the reversing roll $S_{n+2}$.

In the embodiment of FIG. 7A, the second unit 111 is similar to the first unit 110, but, in stead of a mechanical seal J, it is provided with a jet $P_1$, which is produced out of the opening $m_{50}$ in the hood. A part of the air passed into the hood portion R" of the hood R extending into the pocket space F is guided as a curtain jet $P_1$ against the reversing roll $S_{n+1}$, whereby access of air from the pocket space F into the gap between the hood R and the connected constructions is prevented.

In the embodiment shown in FIG. 7A, the third unit 112 comprises a hood R portion R" extending into the pocket space which comprises, after the drying cylinder $K_{n+2}$, portions $R_{10}$ parallel to the straight wire run/web run as well as a curved portion placed against the reversing roll $S_{n+3}$. At the inlet side of the pocket space F, there is an opening $m_{30}$ in the hood, and further down, there is additionally an opening $m_{40}$, through which an air flow is passed into the passage 80 at the inlet side of the pocket space F, into the gap between the curved portion R' of the frame and the drying cylinder $K_{n+2}$. Since the wire H is highly permeable to air, said warm/dry air in the passage 80 is also carried into connection with the web W and promotes the drying of the web W. At the units 111 and 112 in FIG. 7A, the passage 80 terminates in the open air space.

Thus, as is shown in the figure, the unit 112 also includes an opening $m_{40}$ at the end of the frame R portion R" extending into the pocket space F, through which opening an air flow is passed as parallel to the straight wall portion $R_{10}$ of the frame R. Said air flow produces a vacuum between the frame R and the wire H, in which case said vacuum, because the wire is highly permeable to air, promotes adhering of the web W to the face of the wire H on said straight portion. At the unit 112, at the outlet side of the pocket space F, there is an opening $m_{30}$, out of which air is sprayed as a preventive jet to the mouth of the pocket space F so that, by means of said jet, additionally an air flow is induced out of the pocket space F.

Figure 7B:
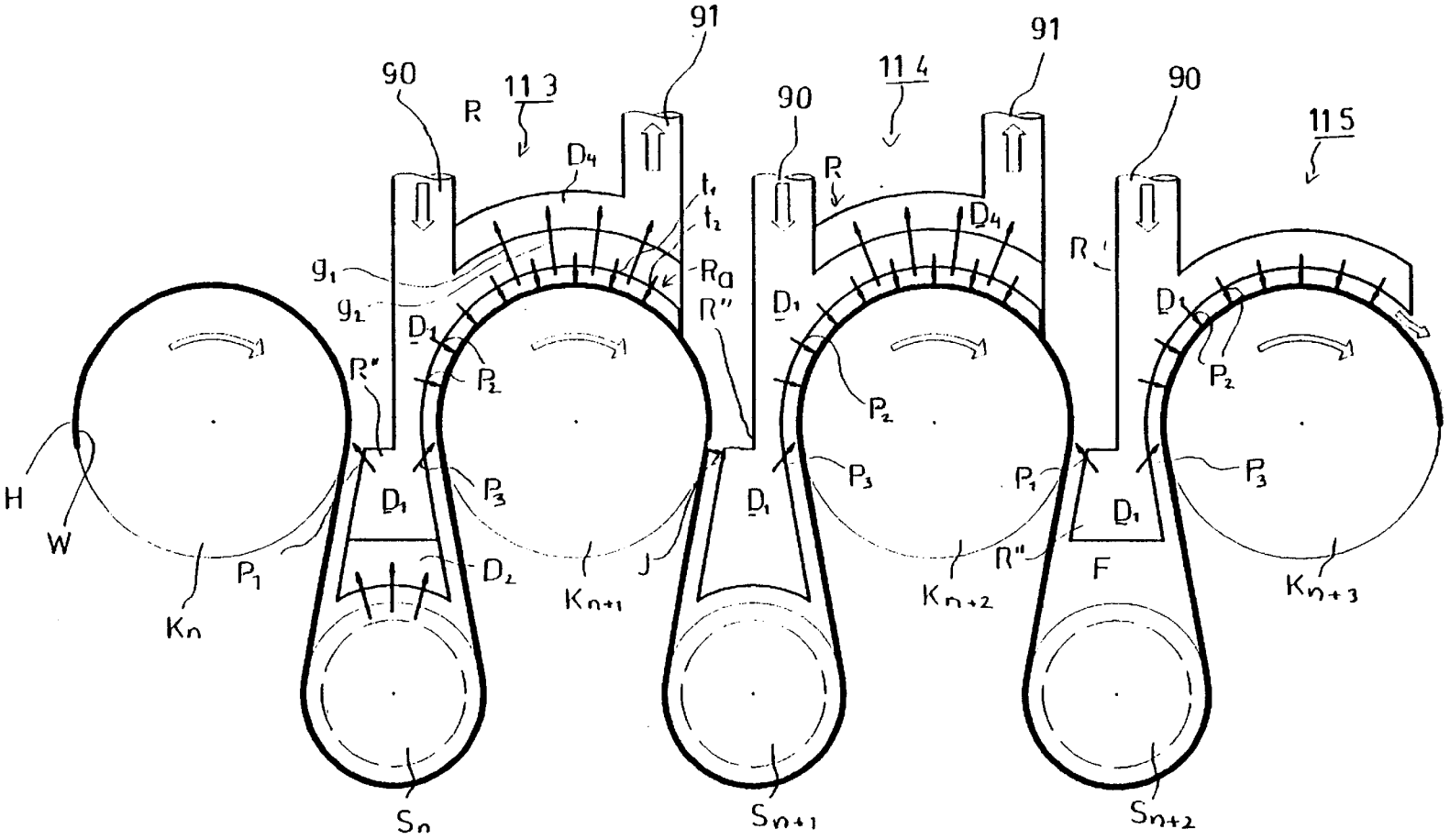

FIG. 7B shows an embodiment of the invention in which the hood R extends into the pocket space F and to above the drying cylinder $K_{n+1}$;$K_{n+2}$ . . . placed after the pocket space F. The hood R portion R" extends into the pocket space F. From the interior of the hood R, the jets $P_1$, $P_3$ and the impingement drying jet $P_2$ are produced. The jets $P_1$ and $P_3$ operate as so-called sealing jets, by whose means a flow past the jets into the pocket space F is prevented, and by whose means, additionally, an exhaust air flow out of the pocket space F is induced.

In connection with FIG. 7B, the impingement drying units are denoted with the reference numerals 113, 114 and 115. The duct of supply of the impingement drying air/runnability air is denoted with the reference numeral 90, and the outlet duct of the exhaust air with the reference numeral 91. In connection with the unit 115, there is no exhaust duct 91, but the air is discharged out of the outlet side end of the hood R, and no separate exhaust suction, of the sort used in the case of the units 113 and 114, has been employed.

As is shown in FIG. 7B, into the first pocket space F the unit 113 has been fitted so that the hood R portion R" of the unit 113 extends into the pocket space F and has a shape corresponding to the shape of the pocket space. The sides of the frame portion R" are parallel to the straight portions of the wire runs, and the end of the frame portion R" complies with the curve form of the reversing roll $S_n$. Air is removed from the interior of the reversing roll $S_n$ through the chamber $D_2$ placed in the end of the frame portion of the hood R extending into the pocket space. In such a case, the reversing roll $S_n$ is a perforated suction cylinder. In the chamber space $D_2$, a vacuum is produced by means of a blower device.

Into the unit 113, a chamber space $D_2$ has been formed, out of which air is sucked so that air is removed through the chamber out of the pocket space F. Similarly, in the unit 113, in its frame portion R" at the mouth of the pocket space F, both at the inlet side and at the outlet side, jets $P_1$ and $P_3$ are produced, by whose means access of air into the pocket space F is prevented and by whose means flow of air is induced out of the pocket space F. Through the duct 90, air is passed into the interior of the frame R, i.e. the hood, which air is preferably dry and/or heated air. Said air is transferred from the interior of the hood R further, for example, through the perforations $t_1$,$t_2$ . . . in the air discharge face Ra of the hood, whose curve form corresponds to the curve form of the cylinder $K_{n+1}$ into connection with the wire H and further with the web W to constitute impingement drying air. Said impingement drying is illustrated by the arrows $P_2$. As is shown in FIG. 7B, air is also removed through the ducts $g_1$ and $g_2$ . . . out of connection with the wire H and the web W. Air is removed through the ducts, preferably pipes $g_1$, $g_2$ . . . , into the chamber space $D_4$ of the hood R. Out of the chamber space $D_4$, air is removed through the exhaust duct 91. The ducts $g_1$,$g_2$ . . . are opened to outside the hood R, and from the opposite end into the chamber space $D_4$ (illustrated in more detail in FIG. 7D).

The hood of the second unit 114 in FIG. 7B fills the pocket space F and corresponds to the shape of the construction parts connected with it. When air is passed through the duct 90 into the interior of the hood R into the space $D_1$, it is passed into the frame portion R" of the hood R extending into the pocket space and from there further as a curtain jet $P_3$ to the outlet side of the pocket space F. At the inlet side of the pocket space F, there is a mechanical seal J, which has been substituted for by a jet $P_1$ at the unit 113.

The frame portion R" of the hood R extending into the pocket space F at the unit 115 extends just halfway into the pocket space F. There is no duct 91 for the exhaust air, nor an exhaust chamber $D_4$. In the other respects the embodiment is similar to the preceding embodiments.

Figure 7C:
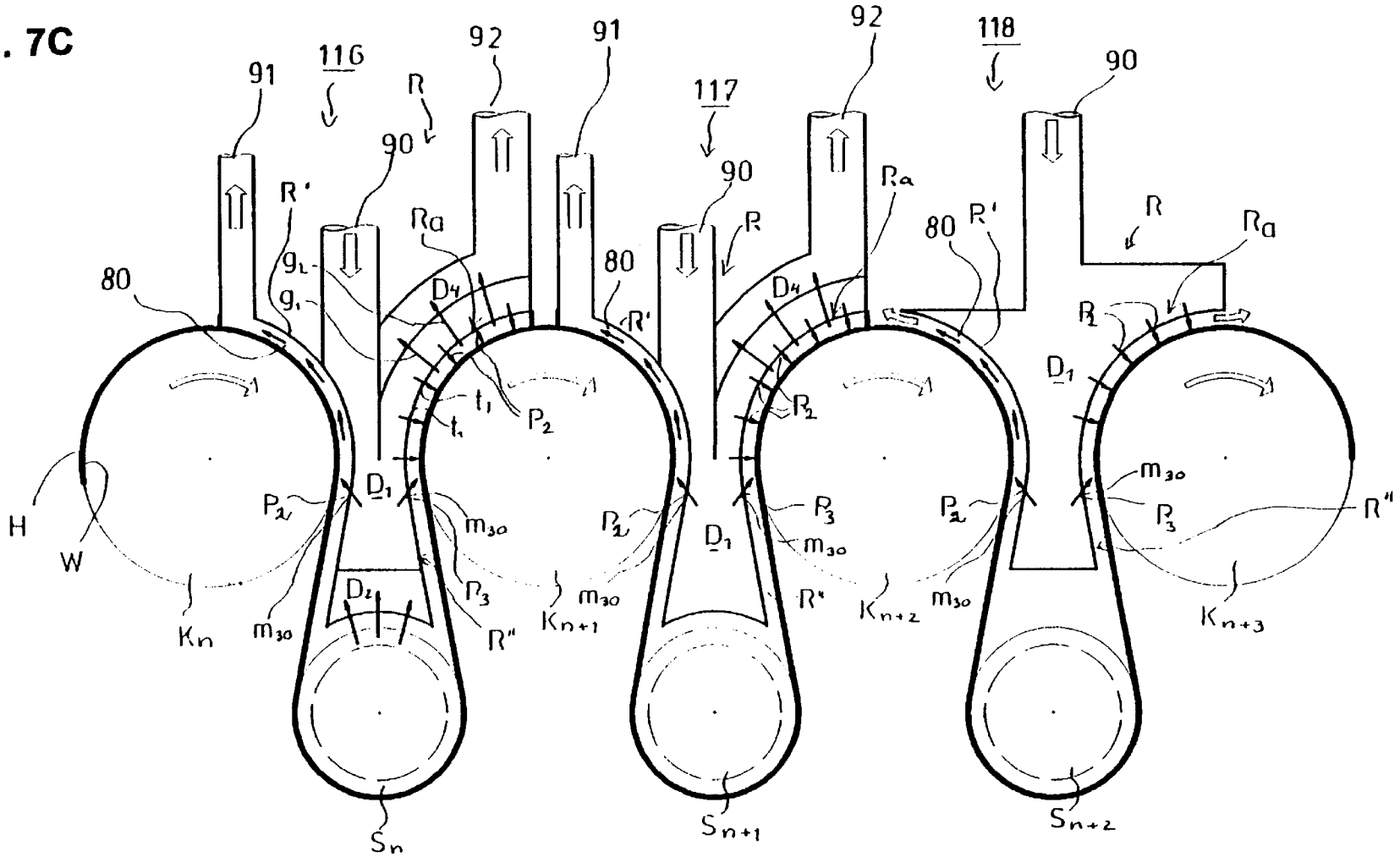

In FIG. 7C, the impingement drying/runnability units are denoted with the reference numerals 116, 117 and 118. The drying cylinders are denoted with the references $K_n$,$K_{n+1}$, $K_{n+2}$, and the reversing rolls are denoted with the references $S_n$,$S_{n+1}$,$S_{n+2}$. The duct that passes the medium flow, preferably flow of dried air or steam, into the interior of the hood R is denoted with the reference numeral 90, and the flow ducts passing out of the interior of the hood R are denoted with the reference numerals 91 and 92.

FIG. 7C shows an embodiment of the invention in which the same hood R has been fitted to extend in connection with both of the drying cylinders $K_{n-1}$ and $K_n$ fitted both at the inlet side and at the outlet side of the pocket space F, so that said hood R additionally extends into the whole pocket space F. The outer face of the hood R has, additionally, been shaped so that it has curved faces which correspond to the shape of the faces both of the drying cylinders $K_n$,$K_{n+1}$ . . . and of the reversing roll $S_n$,$S_{n+1}$ . . . in their vicinity. In the embodiment shown in FIG. 7C, air is passed, similarly to the embodiment of FIG. 7A, through the flow opening $m_{30}$ in the hood R into the narrow space 80 or passage between the curved frame portion R' of the hood R and the drying cylinder $K_n$ and in the direction opposite to the sense of rotation of the drying cylinder (arrows $P_2$). On the other hand, air is passed further through a separate perforated face $t_1$,$t_2$ into connection with the drying cylinder $K_n$ placed at the outlet side so as to constitute impingement drying air $P_2$.

When the air flow is passed through the duct 90 into the interior of the hood R, thus, a part of the flow is passed into the passage 80 to constitute an impingement drying flow, and a part of the flow is passed, to constitute impingement drying medium/impingement drying air, through the perforated face Ra through the wire H into connection with the web W that has been passed onto the face of the drying cylinder. As is shown in the figure, at said locations, in connection with the holes $t_1$,$t_2$ . . . or equivalent, there are additionally exhaust ducts $g_1$,$g_2$ . . . , through which air is also passed away out of connection with the wire H/web W into the chamber $D_4$ in the interior of the hood R and further into the exhaust duct 92 (by means of blowers not shown). The jets $P_1$ and $P_3$ are produced at the inlet side and outlet side of the pocket space F to prevent flow of air into the pocket space F. In the frame portion R" of the hood R extending into the pocket space F, there is a chamber $D_2$, through which air is sucked out of the interior of the reversing roll $S_n$ when said roll is a suction roll. In this way, a vacuum is produced in the interior of the cylinder $S_n$, and a holding suction is applied to the web W through the perforations in the mantle of the cylinder $S_n$. If a roll $S_n$ exclusively provided with a grooved face is used as the reversing roll, by means of the arrangement the grooves can be subjected to a vacuum, whereby the web W is kept in contact with the wire on the roll $S_n$. In such a case, perforations are not needed in the roll $S_n$.

In FIG. 7C, the unit 117 is in the other respects similar to the unit 116, but in the hood portion R" that extends into the pocket space F there is the chamber $D_1$ alone, out of which, through the opening $m_{30}$, jets $P_1$ and $P_3$ are produced to the inlet side and to the outlet side of the pocket space F. The jet $P_2$ coming from the opening $m_{30}$ additionally operates as an impingement drying jet when an air flow is produced into the passage 80 between the curved frame portion R' of the hood R and the drying cylinder $K_{n+1}$.

As is shown in FIG. 7C, the unit 118 comprises a hood R which extends in connection with the adjacent cylinders $K_{n+2}$ and $K_{n+3}$ in which case, through the duct 90, impingement drying/runnability air is passed into the interior of the hood R, and the air is passed further, in the way described above, into the passage 80 into connection with the drying cylinder $K_{n+2}$, and as impingement drying medium through the perforated face $t_1$,$t_2$ . . . or equivalent into connection with the drying cylinder $K_{n+3}$. Similarly, in this embodiment, the jet $P_2$, which is also passed into the passage 80, also operates both as a curtain jet and as an impingement drying jet. The jet $P_3$ at the outlet side of the pocket space F operates as a jet by whose means access of air into the pocket space F is prevented. In connection with the drying cylinder $K_{n+3}$, the hood comprises an air discharge face Ra and therein holes $t_1$,$t_2$ . . . or equivalent, through which the impingement drying air is passed into connection with the wire H and the web W.

Figure 7D:
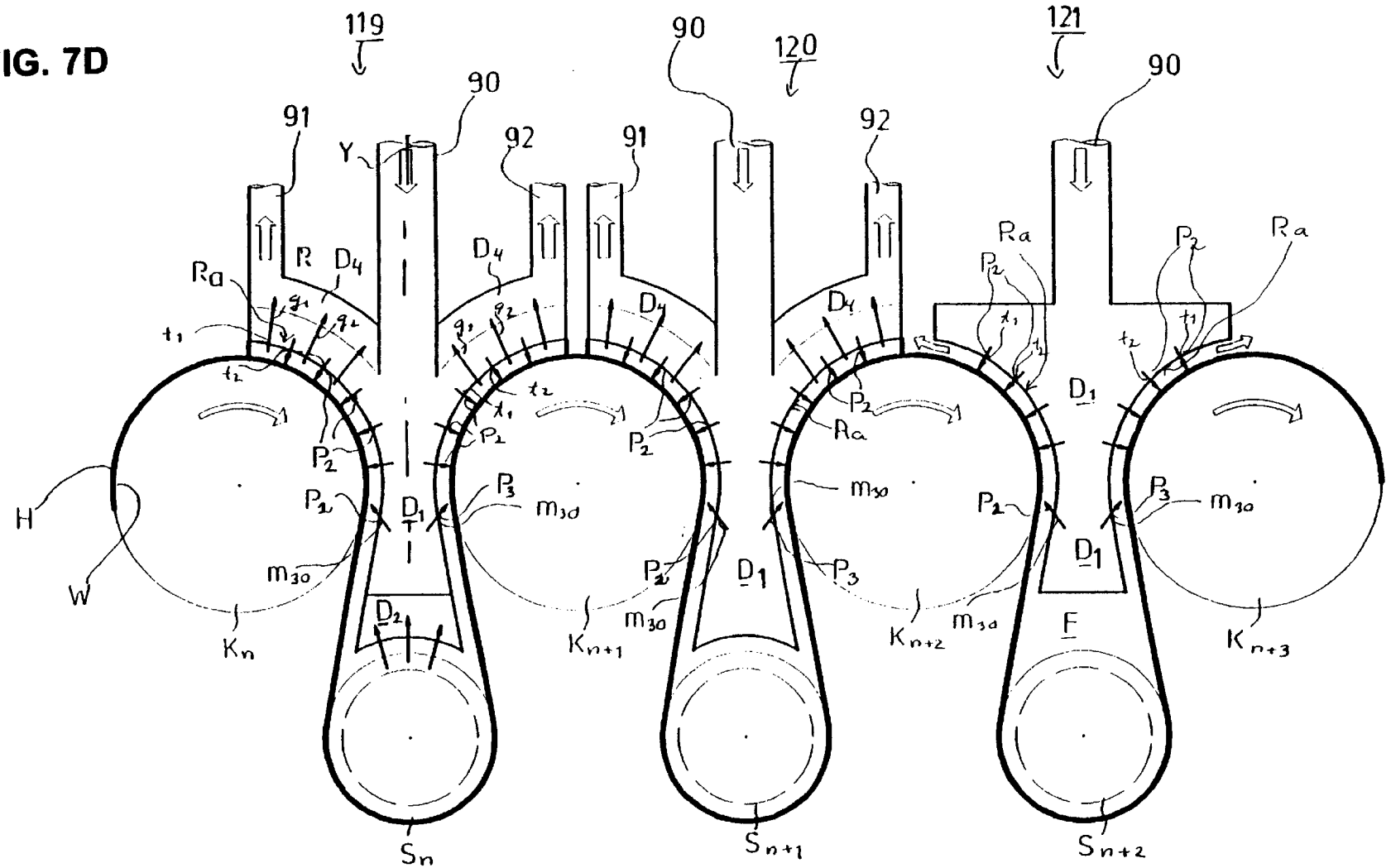

FIG. 7D shows an embodiment of the invention which is in the other respects similar to the embodiment shown in FIG. 7C, but in which the air that has been passed into the hood R is made to flow as impingement drying air through the air discharge face Ra into connection with both of the drying cylinders $K_n$ and $K_{n+1}$. Out of the space $D_1$, runnability jets $P_1$,$P_3$ are also produced to the inlet side and to the outlet side of the pocket space F. By means of the jet $P_1$, access of air into the inlet nip $N_1$ of the reversing roll $S_n$ is prevented, and by means of the jet $P_3$ at the outlet side of the pocket space F, the run of the web W at said outlet side is stabilized and, moreover, air is blown out of the pocket space F and out of the outlet-side nip $N_2$ of the reversing roll $S_n$.

In FIG. 7D, the air is passed through the duct 90 into connection with the unit 119, into the interior of its hood R. The air is divided as impingement drying air $P_2$ into connection both with the drying cylinder $K_n$ and with the drying cylinder $K_{n+1}$ through the perforations $t_1$,$t_2$ . . . in the hood R or through any other, equivalent air discharge face. As is shown in the figure, the hood R portion R" extends into the pocket space F, and it has surface forms that correspond to the straight portions of the web/wire run and to the curve form of the reversing roll $S_n$ at the end of the pocket space F. At the inlet side and outlet side of the pocket space F, the frame comprises air flow openings $m_{30}$ for the jets $P_1$,$P_3$, by whose means access of air into the pocket space F is prevented. Into the separate chamber space $D_2$ at the end of the frame portion R", air is sucked through a separate system of ducts (not shown) from outside the frame portion R" of the hood R. Out of the chamber space $D_1$, which also extends partly into the pocket space F, air is removed, besides through the perforations $t_1$,$t_2$ . . . to constitute impingement drying air, also through the holes $m_{30}$ so as to produce runnability jets $P_1$ and $P_3$. In the embodiment shown in the figure, out of connection with the drying cylinders, air is also removed into the exhaust chambers $D_4$, into which the ducts, preferably pipes $g_1$,$g_2$, pass, which are opened out of connection with the curved face R' of the frame part R of the hood R to outside the frame and from the opposite ends into the exhaust chamber $D_4$ into the interior of the hood R. Air is sucked into the exhaust chamber $D_4$ through the ducts $g_1$ and $g_2$. Being connected with the ducts $g_1$,$g_2$, the exhaust blowers are not illustrated separately.

As is shown in FIG. 7D, the unit 119 has a construction symmetric in relation to the vertical central axis Y of the unit 119. Thus, there are two exhaust ducts 91 and 92. The intake duct 90 is placed on the central axis (Y-axis) of the unit 119.

The unit 120 shown in FIG. 7D is in the other respects similar to the unit 119, except that the hood R portion R"

extending into the pocket space F does not include a separate chamber space $D_2$.

FIG. 7D further shows a unit 121, in which the hood R extends into connection with both of the adjacent drying cylinders $K_{n+2}$,$K_{n+3}$ and partly into the pocket space F. The air is passed through the duct 90 into the hood R interior into the space $D_1$. In the frame portion R" partly extending into the pocket space, the hood R comprises flow openings $m_{30}$ or equivalent, through which jets $P_1$ and $P_3$ are passed to the inlet side and to the outlet side of the pocket space F. From the interior of the hood R, flow openings/flow ducts/flow passages $t_1$,$t_2$ . . . further open in connection with the drying cylinders $K_{n+2}$,$K_{n+3}$ so as to pass the impingement drying medium, preferably air, through the wire H onto the web W. In this embodiment, the unit 121 does not include separate exhaust ducts/exhaust chambers for the air flow to be removed.

FIG. 7E shows a hood R construction related, for example, to the unit 119, in which ducts $g_1$,$g_2$ . . . , preferably pipes, open into the exhaust chamber $D_4$. The pipes $g_1$, $g_2$ . . . have been passed further through the curved face R' of the hood R. Similarly, from the chamber portion $D_1$, holes, openings $t_1$,$t_2$ . . . or equivalent open through the air discharge face Ra of the curved hood portion R', in which case impingement drying air is passed out of the space $D_1$ into connection with the wire H and further with the web W. From outside the hood R, air is also removed through the ducts $g_1$,$g_2$ . . . into the chamber space $D_4$ and further into the discharge duct 92.

Thus, in the solution of equipment in accordance with the present invention, an integrated hood R has been formed, which defines, in its interior, chambers/ducts through which the impingement drying medium, preferably air or steam, is passed into connection with the web W (board web or paper web) in order to dry the web, and in which solution of equipment, advantageously the same impingement drying medium that was introduced into the interior of the hood R is also used to form a runnability component, preferably air jets $P_1$ and $P_3$, in which case the runnability component may consist, for example, of jets substituted for mechanical seals J, by whose means access of air into the pocket space F between the drying cylinders $K_n$,$K_{n+1}$ and the reversing roll $S_n$ is prevented. Thus, in a preferred embodiment of the invention, expressly the same medium, such as air, is used both as the impingement drying medium and as the medium that forms the runnability jet/jets. The medium is branched in the interior of the hood R in accordance with the invention to different sites and purposes of use.

Figure 8A:
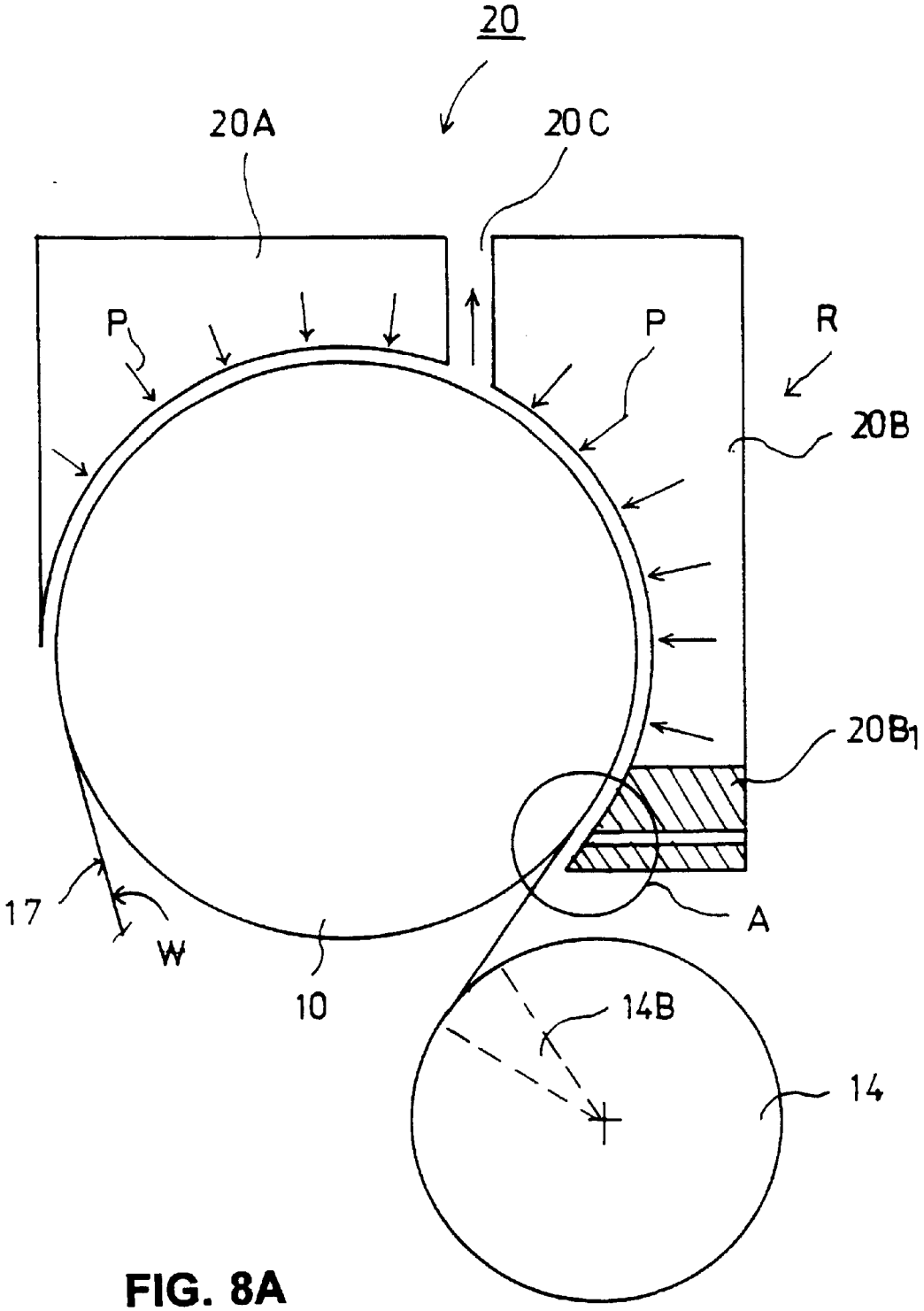
FIGS. 8A . . . 8B are schematic illustrations of an exemplifying embodiment of the invention, in which, in an area with single-wire draw in the dryer section of the paper machine, an impingement drying unit has been fitted, by whose means the evaporation is enhanced and a good runnability is maintained.

FIG. 8A shows a small portion of a dryer group R, in which there is a drying cylinder 10, a perforated reversing cylinder or roll 14, and a nozzle blow unit 20. The nozzle blow unit comprises two parts 20A and 20B. The impingement blowing out of the parts 20A,20B of the nozzle blow unit takes place through the wire 17. The parts 20A,20B of the nozzle blow unit operate in the same way as a normal impingement drying hood does, i.e. they comprise members for carrying out the blowings P and means for removal of moist air. Between the parts 20A,20B of the nozzle blow unit 20, there is a gap 20C meant for removal of air.

At the point A indicated in FIG. 8A, in the prior-art solutions, the paper tends to follow the cylinder 10 in stead of following the wire 17. This produces a stretch in the paper W, which stretch hampers the running of the paper further on the perforated roll 14 unless adhesion to the cylinder is prevented. In the shaded area 20$B_1$ of the part 20B of the nozzle blow unit 20 in accordance with the invention, a vacuum is arranged, which keeps the paper W in tight contact with the wire 17, in which case no stretch can occur. By means of the suction, it is also achieved that the suction substantially reduces the amount of air carried along with the wire into the closing nip of the suction roll, which air attempts to form a bag as a result of the pressure produced by the web in said area. The vacuum is produced by means of suction or by means of the principle of ejection or by applying an air jet parallel to the wire 17 at the point of separation of the paper W and the cylinder 10.

In applications known from the prior art, the use of a blow box 20 has also been justified by means of separation of the paper from the wire 17 face when it arrives on the perforated roll 14. Separation of the paper W at said point can, however, be prevented by, to the sector 14B of the roll 14, applying a vacuum higher than in the prior art, which vacuum keeps the paper W in contact with the wire 17 and with the roll 14 face. The vacuum is 1000 . . . 10,000 Pa, preferably 2000 . . . 4500 Pa. The pressure in the chamber also depends on the area of the holes, in which connection reference is made to the applicant's FI Patent Application 961612.

Figure 8B:
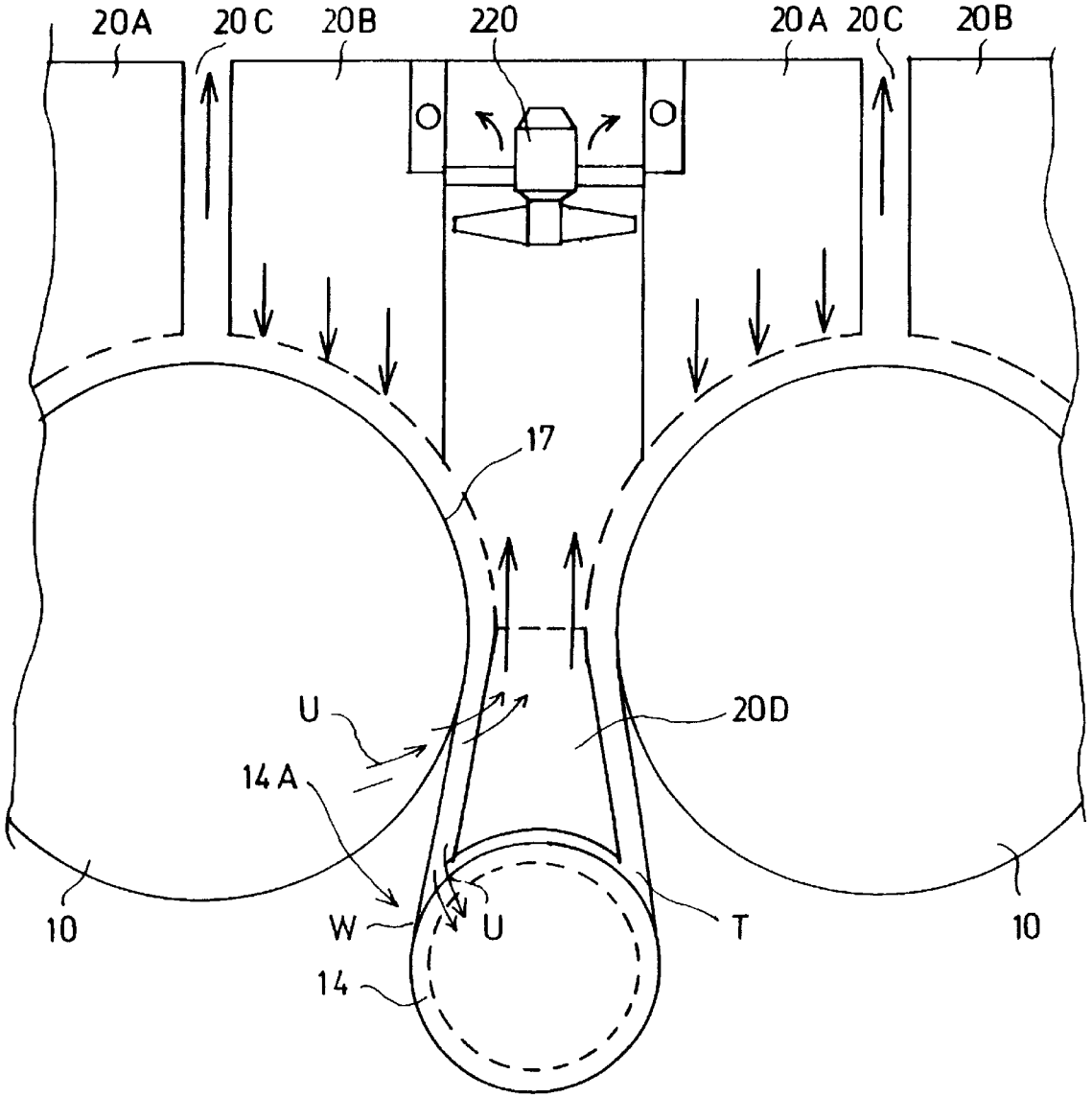

The nozzle blow unit 20 in accordance with this embodiment of the invention enhances the evaporation and, at the same time, improves the runnability. The exemplifying embodiment as shown in FIG. 8A can also be applied in accordance with FIG. 8B, in which case it is also possible to regulate the pressure that is formed in the pocket T. The pocket T is "sealed" by closing it substantially by means of the part 20D, in which case access of extra air into the gap of the roll 14 is prevented, and separation of the web W does not take place when a sufficiently intensive suction U is applied to the web in the gap area (FIG. 8B, point 14D). The intensity of the suction is 500 . . . 10,000 Pa, preferably 2000 . . . 4500 Pa. The roll can also be an open roll provided that the necessary sealing has been arranged. The roll can also be a roll in which no inner parts are employed in the interior of the roll.

When the nozzle blow unit is divided into parts in the cross direction, it can also be used for profiling and for alignment of a distorted moisture profile.

In the exemplifying embodiments shown in FIGS. 8A . . . 8B, the suction blower 22U has been integrated in the constructions of the unit 20, and the air that has been sucked can be passed favourably, after a heat exchanger and after possible addition of dry air, at least partly back to impingement drying, as was described above in relation to FIGS. 6A . . . 6C.

By means of the nozzle blow units in accordance with FIGS. 8A . . . 8B, evaporation is enhanced and good runnability is maintained.

Figure 9:
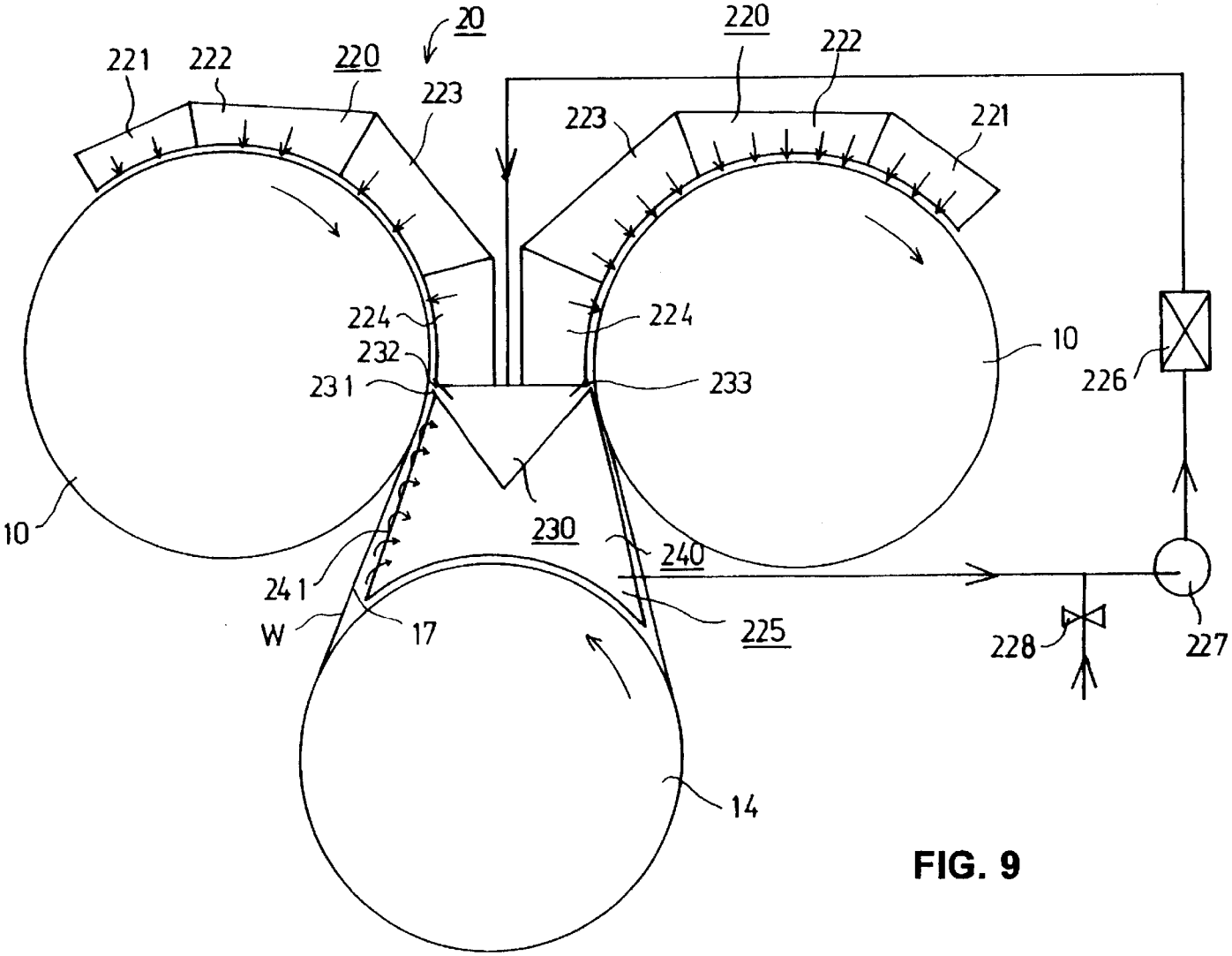
FIG. 9 is a schematic illustration of a preferred exemplifying embodiment of the invention, in which the wall of the runnability unit is corrugated.

In the exemplifying embodiment shown in FIG. 9, impingement drying units 220 have been fitted in connection with two adjacent drying cylinders 10, by means of which impingement drying units impingement drying medium is blown through the wire 17 onto the paper web W in order to dry the web. The impingement drying units 220 are connected with a runnability unit 225, which comprises a pressure chamber 230 and a vacuum chamber 240. At the inlet side of the web W, the pressure chamber 230 is provided with a nozzle opening 231, in whose connection an air guide 232 has been fitted and out of which nozzle opening 231 a runnability blowing is blown into the passage between the cylinder 10 and the impingement drying unit 220, and, similarly, at the outlet side, a nozzle opening 233 has been provided in order to arrange a corresponding blowing. The side wall 241 at the inlet side at the vacuum chamber 240 is corrugated, and in the bottom of each corrugation wave a suction opening has been provided. In this exemplifying embodiment of the present invention, by means of the impingement drying units 220 the drying capacity is increased, and the runnability unit 225 improves the runnability. By means of the runnability unit 225 it is ensured that the paper W remains in contact with the wire 17 on the draw between the cylinder 10 and the reversing roll or cylinder 14. By means of this exemplifying embodiment of the invention, it is ensured in particular that the vacuum in the nip is not reduced as a result of the impingement blowings. A sealing is provided for the blowing blown through the nozzle opening 231, and in the vacuum area air is removed through the suction openings in the corrugated wall 241. The nozzle blowing and the air guide 232 fitted in its connection stop the layer of air that moves along with the wire 17 and prevent pumping of air into the nip. By means of the corrugated wall 241 and by means of the holes formed in the valleys between the waves, turbulence is produced in the layer of air, and any air that may possibly still arrive along with the wire 17, which air is in a state of turbulence, is removed through the openings.

Figure 10:
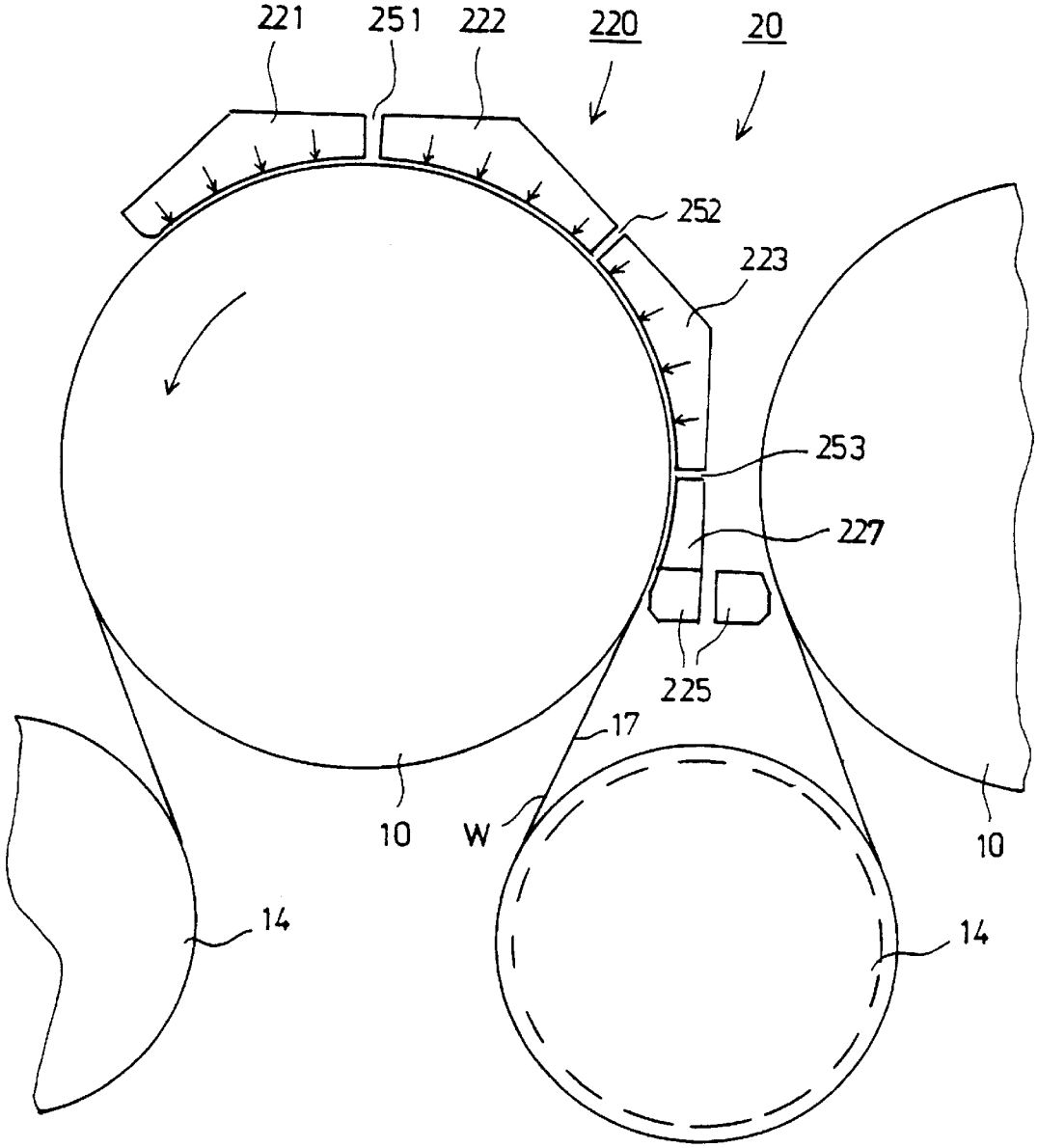
FIG. 10 is a schematic illustration of an exemplifying embodiment of the invention, which is provided with gap spaces between blow blocks and between an ejector part and a blow block for the purpose of removal of air.

In the arrangement shown in FIG. 10, between the blocks 221,222,223 of the impingement drying unit 220 and between the ejector part 227 placed between the runnability unit 225 and the impingement drying unit 220, out of which ejector part runnability blowings can be blown, and the last block 223 in the impingement drying unit 220, air gaps 251,252,253 have been provided, by whose means removal of air is promoted in order that an excessive amount of air should not enter into the closing nip. An arrangement of the type shown in FIG. 10 has also been applied in an experiment carried out by the applicant, and by means of this arrangement an additional evaporating capacity of 4 . . . 5% was achieved per drying cylinder provided with an impingement drying unit when the permeability of the wire was 1500 $m^3/m^2/h$, an additional evaporating capacity of 12 . . . 16% when the permeability of the wire was 3700 $m^3/m^2/h$, and an additional evaporating capacity of 14 . . . 17% when the permeability of the wire was 7500 $m^3/m^2/h$. In the experiments, temperatures of blowing air lower than 120 ° C. and blow rates lower than 80 metres per second were employed.

In the embodiments described above, the impingement drying air can be recirculated air. It can be moist air taken from the face of a felt, or it may also be fresh dry air. In the way described above, the impingement drying air can be separately heated, or for the impingement drying it is also possible to use steam.

In the exemplifying embodiments illustrated in the figures shown above, it is possible, as the wire, to employ a what is called sticky wire, whose face has been treated in order to ensure holding of the wire. Such a wire has a hydrophilic face, which attempts to lock the web on the wires, and, thus, the improved surface properties also attempt to prevent separation of the web. One such what is called sticky wire is the wire marketed by Albany International with the product name Aerogrip™, and in respect of said wire reference is also made to the published EP Patent Application No. 0,761,872. A sticky wire can also be accomplished in compliance with the principles suggested in the U.S. Pat. No. 5,397,438.

Above, the invention has been described with reference to some preferred exemplifying embodiments of same only, the invention being, however, by no means supposed to be strictly confined to said embodiments. Many variations and modifications are possible within the scope of the inventive idea defined in the following claims.

What is claimed is:

1. A method in a dryer section of a paper machine, in which dryer section a normal single-wire draw is applied at least partly, in which method the web (W) is passed through the dryer group on support of a drying sire (17;H), whose permeability to a drying medium is in the range between 2000–20000 $m^3/h/m^2$ (cubic meters per hour per square metre), which drying wire (17;H) presses the web (W) on the drying cylinders (10,$K_n$,$K_{n+1}$ . . . ) against the heated cylinder faces, and in which dryer section the web (W) on the reversing cylinders or rolls (14,$S_n$,$S_{n-1}$ , . . . ) between the drying cylinders (10), remains at the side of the outside curve, and in which dryer section there is provided:

an impingement blowing ($P_2$) on the adjacent drying cylinders (10,$K_n$,$K_{n-1}$ . . . ) and one of a support suction and blowing ($P_1$, $P_3$) inside an intercylinder pocket space (F) defined by the adjacent drying cylinders (10,$K_n$,$K_{n+1}$ . . . ) and the reversing cylinder or roll (14,$S_n$, $S_{n-1}$ . . . ), wherein the suction and blowing ($P_1$, $P_2$, $P_3$) are accomplished by one integrated impingement drying and runnability unit (R,20) extending from the intercylinder pocket (F) onto at least one drying cylinder (10,$K_n$,$K_{n-1}$ . . . ), through which impingement drying and runnability unit is produced:

a suction effect by means of one of the blowing and support suction ($P_1$, $P_3$) through the drying wire (17;H) to the web (W) in order to improve the runnability of the web (W) and to keep the web (W) on the face of the wire and the impingement blowing ($P_2$) through the drying wire (17;H) to the web (W) in order to dry the web (W), regulate a curling of the web (W) and to control a tendency of curling of the web (W).

2. A method as claimed in claim 1, wherein the same medium that is used as drying medium for the web (W) in impingement drying is used for controlling the runnability of the web.

3. A method as claimed in claim 1, wherein heating medium is passed as a curtain jet to one of the inlet side and outlet side of the pocket space (F), and said heating medium is passed as an ejection jet to one of the inlet and outlet side of the pocket space (F), onto a straight web that runs onto the face of a grooved perforated reversing roll ($S_n$,$S_{n+1}$ . . . ).

4. A method as claimed in claim 1, wherein carriage of the impingement drying medium along with the wire (17) into the pocket space (F) is prevented by means of a blowing arranged in connection with the runnability unit (225), blown out of the nozzle opening (232), and directed by means of the air guide (231).

5. A method as claimed in claim 1, wherein in the method, a block (20$B_1$) that communicates with a source of vacuum is employed at the outlet edge of the impingement drying unit (20B) in order to produce a vacuum in the area of the outlet edge of the impingement drying unit (20B).

6. A method as claimed in claim 1, wherein a blower (220) is employed in order to produce one of vacuums and pressures in connection with the impingement drying unit (20A,20B) in connection with the runnability unit (20D).

7. A device in the dryer section of a paper machine, which dryer section is at least partly accomplished by means of dryer groups with normal single-wire draw, in which dryer groups the web (W) is fitted to be passed through the dryer group on support of a drying wire (17;H), whose permeability to a drying medium is in the range between 2000–20000 $m_3/h/m_2$ (cubic meters per hour per square metre), and in which dryer groups there are drying cylinders (10;$K_n$,$K_{n-1}$ . . . ) against whose heated cylinder faces the web (W) is fitted to be pressed by means of the drying wire (17,H), and in which dryer groups, on the reversing cylinders or rolls (14;$S_n$,$S_{n+1}$ . . . ) between the dryer cylinders (10), the web (W) is placed at the side of the outside curve, and which dryer section is provided with:

an impingement drying means extending at least onto one of the adjacent drying cylinders (10, $K_n$,$K_{n-1}$ . . . ) and one of support and support suction means locating inside an intercylinder pocket space (F) defined by the adjacent drying cylinders (10, $K_n$,$K_{n+1}$ . . . ) and the reversing cylinder or roll (14; $S_n$, $S_{n+1}$ . . . ), wherein in the dryer groups, from the intercylinder pocket space (F) onto at least one drying cylinder (10,$K_n$,$K_{n+1}$ . . . ) extends one integrated impingement drying and runnability unit (R,20), through which:

a suction effect by means of one of the blowing and support suction ($P_1$, $P_3$) is applied to the web through the drying wire (17;H) in order to improve the runnability of the web, and the impingement blowing ($P_2$) is applied into connection with the web (W) through the drying wire (17;H) in order to dry the paper web (W).

8. A device as claimed in claim 7, wherein from the interior of the hood (R), additionally an air jet ($P_1$) is passed to the inlet side of the pocket space (F) to produce a preventive jet so that air cannot pass into the pocket space (F), and a second air jet ($P_2$) is passed at the outlet side of the pocket space (F) to constitute an ejection jet so as to remove air out of the pocket space (F), in which case said jet is preferably directed as parallel to the running direction of the wire, in which case it operates both as a jet that removes air in evacuation of air out of the pocket space (F) and as jet that produces a vacuum between the hood (R) and the wire (H), in which connection the vacuum is transferred through the wire (H), and the web (W) adheres, by means of the vacuum thus produced, to the wire face, and the running of the web (W) is stabilized.

9. A device as claimed in claim 7, wherein in connection with the drying cylinder ($K_n$) and with the subsequent suction roll ($S_n$) and with the subsequent drying cylinder ($K_{n+1}$), the device comprises impingement drying units and runnability units (116,117,118; 119,120,121), whose hood (R) extends into connection with both of the drying cylinders ($K_n$,$K_{n+1}$) and, further, into the pocket space (F) placed between the drying cylinders ($K_n$,$K_{n-1}$), in which connection the air that has been passed into the interior of the frame (R) is passed as impingement drying air into connection with both of the drying cylinders ($K_n$,$K_{n+1}$) and further as one of a seal and curtain jets to prevent any flow of air into the pocket space (F), in which case a jet that prevents a flow of air into the pocket space is placed at one of the inlet side and outlet side of the pocket space.

10. A device as claimed in claim 7, wherein in their connection, the drying cylinders ($K_n$,$K_{n-1}$) comprise a hood (R), which extends into the pocket space (F), and that out of the hood (R) there s a flow opening ($m_{30}$) a flow gap, through which air is made to flow into the passage (80) between the curved frame face (R') of the hood (R) and the drying cylinders ($K_n$,$K_{n-1}$) and as impingement drying air into connection with the web (W).

11. A device as claimed in claim 10, wherein the device comprises a hood (R) into whose interior heating medium is introduced so that a part of the air is passed through the curved perforated face (Ra) placed in connection with the drying cylinder ($K_n$) at the outlet side of the pocket space (F) through the wire (H) into connection with the web (W) to constitute impingement drying air, and that a part of the air that has been introduced into the interior of the hood is passed into the hood (R) portion (R") extending into the pocket space (F) and further as a jet at one of the inlet side and outlet side of the pocket space (F) into the gap between the hood (R) and the wire (H) face to prevent a leakage flow of air into the pocket space (F).

12. A device as claimed in claim 7, wherein into the pocket space (F) a blow box (20) has been fitted, by whose means an ejection blowing ($P_1$) is fitted to be produced onto the straight runs between the drying cylinders (10) and the reversing cylinders or rolls (14) in order to improve the runnability at the inlet side, and that, by means of said blow box (20), blowings ($P_2$) that dry the paper web (W) at the outlet side are fitted to be produced, which blowing ($P_2$) are fitted to be blown towards the web (W) through the wire (17).

13. A device as claimed in claim 12, wherein the blow box (20) that forms the device comprises an additional nozzle at the outlet side in order to produce a runnability and drying blowing ($P_3$) to be blown in the running direction of the web (W).

14. A device as claimed in claim 12, wherein the side wall (26) of the blow box (20) at the outlet side follows the face of the adjacent cylinder (10) at the distance of the necessary safety clearance.

15. A device as claimed in claim 12, wherein there is an ejection nozzle at the inlet side of the blow box (20).

16. A device as claimed in claim 12, wherein the nozzles of the blow box (20) at the outlet side are direct-blow nozzles.

17. A device as claimed in claim 7, wherein in connection with the runnability unit, a nozzle blowing has been arranged in order to prevent carriage of the impingement drying medium along with the wire (17) into the pocket space.

18. A device as claimed in claim 17, wherein the wall of the runnability unit (225) at the inlet side of the web (W) is corrugated and communicates with a suction chamber (24) through suction openings.

19. A device as claimed in claim 7, wherein in connection with the impingement drying unit (20A,20B), at its outlet edge, there is a block (20$B_1$), which communicates with a source of vacuum.

20. A device as claimed in claim 7, wherein in connection with the device, a blower (220) has been fitted in order to produce one of the necessary vacuums and pressures.

21. A device as claimed in claim 7, wherein the device comprises a blower (220) for producing the vacuum necessary in the device, which blower is connected with a heat exchanger to pass the air that has been sucked through the heat exchanger, and to pass the air back into the impingement drying units.

* * * * *